US011233311B2

(12) United States Patent
Kim et al.

(10) Patent No.: US 11,233,311 B2
(45) Date of Patent: Jan. 25, 2022

(54) SYSTEM AND METHOD FOR AN ISOLATOR FOR A HINGE CAVITY OF AN INFORMATION HANDLING SYSTEM HAVING ONE OR MORE ANTENNA ELEMENTS

(71) Applicant: Dell Products, LP, Round Rock, TX (US)

(72) Inventors: Changsoo Kim, Cedar Park, TX (US); Suresh K. Ramasamy, Cedar Park, TX (US); Timothy C. Shaw, Austin, TX (US); Geroncio O. Tan, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 170 days.

(21) Appl. No.: 16/778,745

(22) Filed: Jan. 31, 2020

(65) Prior Publication Data

US 2021/0242566 A1 Aug. 5, 2021

(51) Int. Cl.
*H01Q 1/24* (2006.01)
*H01Q 1/22* (2006.01)
*H01Q 1/52* (2006.01)

(52) U.S. Cl.
CPC ..... *H01Q 1/2266* (2013.01); *H01Q 1/52* (2013.01); *H01Q 1/521* (2013.01)

(58) Field of Classification Search
CPC ..... H01Q 1/2266; H01Q 1/521; H01Q 1/52; H01Q 1/243
See application file for complete search history.

(56) References Cited

U.S. PATENT DOCUMENTS

2013/0293426 A1* 11/2013 Hung ..... H01Q 1/22 343/702
2014/0097993 A1* 4/2014 Hotta ..... H01Q 1/243 343/702

* cited by examiner

*Primary Examiner* — Dieu Hien T Duong
(74) *Attorney, Agent, or Firm* — Prol Intellectual Property Law, PLLC; H. Kenneth Prol

(57) ABSTRACT

An information handling system to wirelessly transmit and receive data at an antenna may include a processor; a memory; a wireless adapter; a base metal chassis containing components of the information handling system, the base metal chassis including a C-cover and D-cover housing the components; a display metal chassis containing components of the information handling system, the display metal chassis including an A-cover and a B-cover housing the components; a hinge cavity formed at a hinge used to couple the base metal chassis and display metal chassis; a first antenna element formed within the C-cover near the hinge; a second antenna element formed within the C-cover near the hinge; and an edge resonant isolator formed into the A-cover to disrupt an electrical ground coupling path formed between the base metal chassis and display metal chassis at the hinge cavity, wherein the edge resonant isolator includes a plurality of slits formed into the A-cover.

20 Claims, 10 Drawing Sheets

SYSTEM AND METHOD FOR AN ISOLATOR FOR A HINGE CAVITY OF AN INFORMATION HANDLING SYSTEM HAVING ONE OR MORE ANTENNA ELEMENTS

FIELD OF THE DISCLOSURE

The present disclosure generally relates to information handling systems, and more particularly relates to an information handling system including one or more antennas placed near a hinge cavity and an edge resonant isolator to isolate radio-frequency (RF) electromagnetic (EM) waves emitted by the one or more antennas.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

For purposes of this disclosure, an information handling system may include any instrumentality or aggregate of instrumentalities operable to compute, calculate, determine, classify, process, transmit, receive, retrieve, originate, switch, store, display, communicate, manifest, detect, record, reproduce, handle, or utilize any form of information, intelligence, or data for business, scientific, control, or other purposes. For example, an information handling system may be a personal computer (e.g., desktop or laptop), tablet computer, mobile device (e.g., personal digital assistant (PDA) or smart phone), server (e.g., blade server or rack server), a network storage device, or any other suitable device and may vary in size, shape, performance, functionality, and price. The information handling system may include random access memory (RAM), one or more processing resources such as a central processing unit (CPU) or hardware or software control logic, read-only memory (ROM), and/or other types of nonvolatile memory. Additional components of the information handling system may include one or more disk drives, one or more network ports for communicating with external devices as well as various input and output (I/O) devices, such as a keyboard, a mouse, touchscreen and/or a video display. The information handling system may also include one or more buses operable to transmit communications between the various hardware components. The information handling system may also include telecommunication, network communication, and video communication capabilities. The information handling system may also include one or more buses operable to transmit communications between the various hardware components. The information handling system may also include telecommunication, network communication, and video communication capabilities. Information handling system chassis parts may include case portions such as for a laptop information handling system including the C-cover over components designed with a metal structure. The information handling system may be configurable with a plurality of antennas formed near a hinge cavity at a hinging point between a C-cover and A-cover of the information handling system.

BRIEF DESCRIPTION OF THE DRAWINGS

It will be appreciated that for simplicity and clarity of illustration, elements illustrated in the Figures are not necessarily drawn to scale. For example, the dimensions of some elements may be exaggerated relative to other elements. Embodiments incorporating teachings of the present disclosure are shown and described with respect to the drawings herein, in which.

The use of the same reference symbols in different drawings may indicate similar or identical items.

DETAILED DESCRIPTION OF THE DRAWINGS

Figure 1:
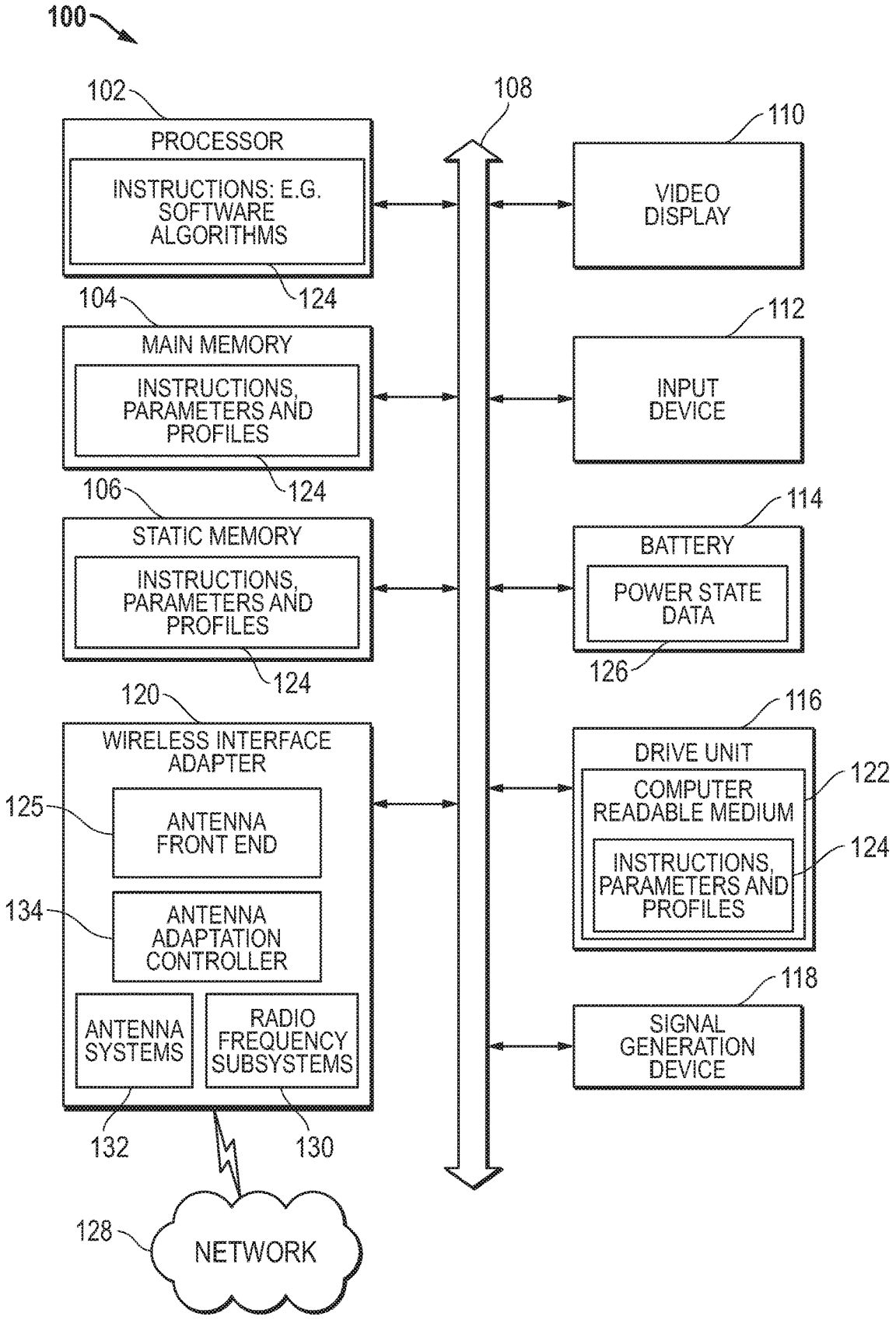
FIG. 1 illustrates an embodiment of information handling system according to an embodiment of the present disclosure.

The following description in combination with the Figures is provided to assist in understanding the teachings disclosed herein. The description is focused on specific implementations and embodiments of the teachings, and is provided to assist in describing the teachings. This focus should not be interpreted as a limitation on the scope or applicability of the teachings.

For aesthetic, strength, and performance reasons, information handling system chassis parts are more commonly designed with a metal structure. In an embodiment, a laptop information handling system, for example, may include a plurality of metallic covers for the interior components of the information handling system. In these embodiments, a form factor case may include an "A-cover" which serves as a back cover for a display housing and a "B-cover" which may serve as the bezel, if any, and a display screen of the convertible laptop information handling system in an embodiment. Together, in an embodiment, the A-cover and B-cover may form an enclosure as a display chassis to house various components of the information handling system such as a camera and a display device, among other components. In a further example, the laptop information handling system case may include a "C-cover" housing a keyboard, touchpad, and any cover in which these components are set and a "D-cover" base housing or base chassis for the convertible information handling system. Together, in an embodiment, the C-cover and D-cover may form an enclosure to house various components of the information handling system such as a keyboard, processors, a data storage device, and a plurality of antenna elements, among other components. With the need for utility of lighter, thinner, and more streamlined devices, the use of full metal portions for the outer covers of the display and base housing (e.g. the A-cover and the D-cover) is desirable for strength as well as aesthetic reasons. At the same time, the demands for wireless operation also increase. This includes addition of many simultaneously operating radiofrequency systems, addition of more antennas, and utilization of various antenna types. However, the thinner and more streamlined devices have fewer locations and area available for mounting radiofrequency transmitters on these mobile information handling systems. Additionally, the use of antennas may cause an excitation of the metal surfaces of the covers described herein leading to destructive interference in the signals sent by the antenna. Thus, a streamlined, full metal chassis capable of meeting the increasing wireless operation demands is needed.

Previous information handling systems would address these competing needs by providing for cutout portions of a metal outer chassis cover filled with plastic behind which radiofrequency transmitters/receivers would be mounted. The cutouts to accommodate radio frequency (RF) transmitters/receivers are often located in aesthetically undesirable locations or required additional plastic components to cover the cutout, thus not fully meeting the streamlining needs. The plastic components added a component that may be manufactured and seamlessly integrated into the metal chassis cover. A number of processes may be used to integrate the metal and plastic parts into a single chassis. This requirement could require difficult and expensive processes to manufacture with a less desirable result. The issue of antenna location is compounded with the need to deploy multiple antennas which may operate concurrently in some embodiments. For example, to achieve current gigabit 5G long term evolution (LTE) speeds, 4×4 LTE antenna systems using four LTE antennas may be needed in some embodiments. Other options included, for aperture type antenna transmitters, the creation of an aperture in the metal display panel chassis and using the metal chassis as a ground plane for excitation of the aperture.

The number of potential locations used by antenna systems within the computing device, the potential locations within the metal covers of the information handling systems may be limited. This may be especially true where a size of a display device of the information handling system is increased. By increasing the size of the display device, the ability of a user to interact with the information handling system is increased. However, with the increased size of the display device, any components of the information handling system, such as the antenna systems, within the A-cover and B-cover assembly are pushed out of the A-cover and B-cover assembly and into a C-cover and D-cover assembly. In order to make efficient use of the footprint within the C-cover and D-cover assembly, antennas may be located near the hinge portion coupling the A-cover and B-cover assembly to the C-cover and D-cover assembly resulting in a resonant cavity that resonant RF EM signals from a plurality of antenna elements.

As a result of placing a plurality of antennas or antenna systems near the hinge, the RF signals emitted by each individual antenna element may overlap and interfere, such as via destructive interference, with each other. In an embodiment the antennas may also interfere with each other via ground current coupling path via the motherboard or across the hinge. Specifically, antenna ground currents may couple through the hinge into the metal A-cover and back to another antenna port in the D-cover and C-cover assembly or via the motherboard. This results in a hinge cavity resonant mode, that dominate at certain frequencies or harmonics when compared to the antenna coupling or via the motherboard. In an example, the antenna coupling via the motherboard may be alleviated by adding antenna isolators in between antennas in the base to help break the ground coupling path. However, this does not resolve the hinge coupling that results in the hinge cavity resonant modes produced at the hinge between the plurality of antenna elements. In order to overcome the creation of interfering hinge cavity resonant modes and ground coupling path across the hinge, the present specification describes the use of an isolation element formed into the A-cover near one or more antennas. The isolator element formed within the A-cover is created by carve out breaks or slits in the bottom edge of the A-cover so as to create a multi-band resonant structure that counters any coupling currents originating at the C-cover and D-cover assembly into the A-cover, the multiband resonant isolator structure on the edge of the A-cover may also be tuned to provide a resonant mode at each antenna element. In an embodiment, the size of the breaks or slits in the A-cover are modulated and tuned to resonate in a target frequency or harmonics thereof by the antenna elements. A pattern of narrower and wider slits may be introduced in order to decouple, for example, high bands and mid-long-term evolution (mid-LTE) bands respectively. In an embodiment, the location of slits formed in or at the A-cover may be strategically placed relative to an antenna element and sized or spaced for fundamental mode excitation for one or more target frequencies. The sizing and spacing may be varied as well to accommodate multiple bands for isolation as well as enhancing nearby antenna resonance in a hinge cavity. For example, a first set of narrow slits and a second set or relatively wider slits may be used in the edge resonant isolator to decouple high band frequencies from lower-band frequencies respectively. The pattern of slits of the isolator elements may be customized and tuned between different information handling system builds stamping the pattern of the isolator element to the A-cover or by welding it. In an embodiment, the isolator element may be finished with an insert molded plastic support and subsequently painted to conceal the isolator element along the A-cover edge.

Embodiments of the present disclosure may decrease the complexity and cost of creating chasses for information handling systems by forming the outer chassis (e.g. the A-cover or the D-cover) entirely of metal and co-locating a plurality of antennas close to or within a hinge placed between the A-cover and B-cover assembly and the C-cover and D-cover assembly. This placement of theses antennas at a location within the C-cover by the hinge provides for a relatively more streamlined information handling system as described herein. Additionally, the placement of these antennas by the hinge provides for additional space at the B-cover to expand the size of any video display device of the information handling system.

The metal chassis in embodiments described herein may include a hinge operably connecting the A-cover to the D-cover such that the keyboard and touchpad enclosed within the C-cover and attached to the D-cover may be placed in a plurality of configurations with respect to the digital display enclosed within the B-cover and attached to the A-cover. The plurality of configurations may include, but may not be limited to, an open configuration in which the A-cover is oriented at a right or obtuse angle from the D-cover (similar to an open laptop computer), a closed configuration in which the A-cover lies substantially parallel to the D-cover (similar to a closed laptop computer), and a tablet configuration in which the A-cover is rotated nearly 360 degrees from its closed orientation (placing the D-cover directly beneath the A-cover, such that the user can interact with the digital display enclosed within the B-cover) or other orientations such as an easel orientation. Despite these different configurations, however, the antenna systems disclosed herein provides for the streamlining of the information handling system without compromising the ability of the antenna or antennas deployed near the hinge to transmit and receive data from and to the information handling system.

Manufacture of embodiments of the present disclosure may involve fewer extraneous parts than previous chasses by forming the exterior or outer portions of the information handling system, including the bottom portion of the D-cover and the top portion of the A-cover, from metal with a small portion of the A-cover being cut away, the isolator element being placed in the cut-out portion of the A-cover, a plastic molded around the isolator element, and the plastic painted to, in an example, match the color of the A-cover. In order to allow for manufacture of fully metallic outer chasses including the A-cover and the D-cover, embodiments of the present disclosure create the form factor case enclosing the information handling system such that a plurality of transmitting antennas near the hinge of the information handling system may concurrently transmit a plurality of different RF EM waves.

The transmitting antennas of embodiments of the present disclosure may include aperture antennas. Aperture antennas in embodiments of the present disclosure may be a highly effective improvement on wireless antennas employed in previous information handling systems. In embodiments of the present disclosure, an antenna aperture or slot may be located in the base chassis along an edge with the hinge. An aperture associated with the antenna in embodiments of the present disclosure may cause the edges of the aperture to act as RF excitable structures. Such a method of placing an aperture associated with the antenna at a location near the hinge of the form factor case may exclude the integration of any RF transparent plastic windows elsewhere within the exterior of the C-cover or other covers of the information handling system, thus decreasing the complexity and cost of manufacture. In other embodiments, a plastic or other RF-transparent window may be located over an aperture near the hinge if some type of water resistance is needed for example.

Examples are set forth below with respect to particular aspects of an information handling system including case portions such as for a laptop information handling system including the chassis components designed with a metal structure and configurable such that the information handling system may operate in any of several usage mode configurations.

FIG. 1 shows an information handling system 100 capable of administering each of the specific embodiments of the present disclosure. The information handling system 100, in an embodiment, can represent the mobile information handling systems 210, 220, and 230 or servers or systems located anywhere within network 200 described in connection with FIG. 2 herein, including the remote data centers operating virtual machine applications. Information handling system 100 may represent a mobile information handling system associated with a user or recipient of intended wireless communication. A mobile information handling system may execute instructions via a processor such as a microcontroller unit (MCU) operating both firmware instructions or hardwired instructions for the antenna adaptation controller 134 to achieve WLAN or WWAN antenna optimization according to embodiments disclosed herein. The application programs operating on the information handling system 100 may communicate or otherwise operate via concurrent wireless links, individual wireless links, or combinations over any available radio access technology (RAT) protocols including for example, operation of multiple LTE antennas to achieve WiGig or other 5G LTE gigabit wireless data speeds. These application programs may operate in some example embodiments as software, in whole or in part, on an information handling system while other portions of the software applications may operate on remote server systems. The antenna adaptation controller 134 of the presently disclosed embodiments may operate as firmware or hardwired circuitry or any combination on controllers or processors within the information handing system 100 for interface with components of a wireless interface adapter 120. It is understood that some aspects of the antenna adaptation controller 134 described herein may interface or operate as software or via other controllers associated with the wireless interface adapter 120 or elsewhere within information handling system 100. Information handling system 100 may also represent a networked server or other system from which some software applications are administered or which wireless communications such as across WLAN or WWAN may be conducted. In other aspects, networked servers or systems may operate the antenna adaptation controller 134 for use with a wireless interface adapter 120 on those devices similar to embodiments for WLAN or WWAN antenna optimization operation according to according to various embodiments.

The information handling system 100 may include a processor 102 such as a central processing unit (CPU), a graphics processing unit (GPU), or both. Moreover, the information handling system 100 can include a main memory 104 and a static memory 106 that can communicate with each other via a bus 108. As shown, the information handling system 100 may further include a video display unit 110, such as a liquid crystal display (LCD), an organic light emitting diode (OLED), a flat panel display, or a solid-state display. Display 110 may include a touch screen display module and touch screen controller (not shown) for receiving user inputs to the information handling system 100. Touch screen display module may detect touch or proximity to a display screen by detecting capacitance changes in the display screen. Additionally, the information handling system 100 may include an input device 112, such as a keyboard, and a cursor control device, such as a mouse or touchpad or similar peripheral input device. The information handling system may include a power source such as battery 114 or an A/C power source. The information handling system 100 can also include a disk drive unit 116, and a signal generation device 118, such as a speaker or remote control. The information handling system 100 can include a network interface device such as a wireless adapter 120. The information handling system 100 can also represent a server device whose resources can be shared by multiple client devices, or it can represent an individual client device, such as a desktop personal computer, a laptop computer, a tablet computer, a 360-degree convertible device, a wearable computing device, or a mobile smart phone.

The present disclosure contemplates a computer-readable medium that includes instructions, parameters, and profiles 124 or receives and executes instructions, parameters, and profiles 124 responsive to a propagated signal; so that a device connected to a network 128 can communicate voice, video or data over the network 128. Further, the instructions 124 may be transmitted or received over the network 128 via the network interface device or wireless adapter 120.

Information handling system 100 includes one or more application programs 124, and Basic Input/Output System and firmware (BIOS/FW) code 124. BIOS/FW code 124 functions to initialize information handling system 100 on power up, to launch an operating system, and to manage input and output interactions between the operating system and the other elements of information handling system 100. In a particular embodiment, BIOS/FW code 124 reside in memory 104, and include machine-executable code that is executed by processor 102 to perform various functions of information handling system 100. In another embodiment (not illustrated), application programs and BIOS/FW code reside in another storage medium of information handling system 100. For example, application programs and BIOS/FW code can reside in drive 116, in a ROM (not illustrated) associated with information handling system 100, in an option-ROM (not illustrated) associated with various devices of information handling system 100, in storage system 107, in a storage system (not illustrated) associated with network channel of a wireless adapter 120, in another storage medium of information handling system 100, or a combination thereof. Application programs 124 and BIOS/FW code 124 can each be implemented as single programs, or as separate programs carrying out the various features as described herein.

The information handling system 100 can include sets of instructions 124 that can be executed to cause the computer system to perform any one or more desired applications. In many aspects, sets of instructions 124 may implement wireless communications via one or more antenna systems 132 available on information handling system 100. Operation of WLAN and WWAN wireless communications may be enhanced or otherwise improved via WLAN or WWAN antenna operation adjustments via the methods or controller-based functions relating to the antenna adaptation controller 134 disclosed herein. For example, instructions or a controller may execute software or firmware applications or algorithms which utilize one or more wireless links for wireless communications via the wireless interface adapter as well as other aspects or components. For example, concurrent operations of plurality antennas, such as of a 4×4 LTE system, may be used to advance high wireless throughput levels of 5G LTE protocols. In such a case, location of two or more antennas may be located in a base chassis along a hinge with the display chassis.

The antenna adaptation controller 134 may execute instructions as disclosed herein for monitoring wireless link state information, information handling system configuration data, SAR proximity sensor detection, or other input data to generate channel estimation and determine antenna radiation patterns. In the embodiments presented herein, the antenna adaptation controller 134 may execute instructions as disclosed herein to transmit a communications signal from an antenna located near a hinge of the information handling system to transmit an electromagnetic wave at a determined frequency or harmonics thereof. In an embodiment, the antenna adaptation controller 134 may execute instructions to adjust, via a parasitic coupling element, change the directionality and/or pattern of the emitted RF signals from the antenna. The antenna adaptation controller 134 may implement adjustments to wireless antenna systems and resources via a radio frequency integrated circuit (RFIC) front end 125 and WLAN or WWAN radio module systems within the wireless interface device 120. Aspects of the antenna optimization for the antenna adaptation controller 134 may be included as part of an antenna front end 125 in some aspects or may be included with other aspects of the wireless interface device 120 such as WLAN radio module such as part of the radio frequency (RF) subsystems 130. The antenna adaptation controller 134 described in the present disclosure and operating as firmware or hardware (or in some parts software) may remedy or adjust one or more of a plurality of antenna systems 132 via selecting power adjustments and adjustments to an antenna adaptation network to modify selection among plural, concurrently operating antennas, antenna radiation patterns, and parasitic coupling element operations.

Multiple WLAN or WWAN antenna systems may operate on various communication frequency bands such as under IEEE 802.11a and IEEE 802.11g (i.e., medium frequency (MF) band, high frequency (HF) band, very high frequency (VHF) band, ultra-high frequency (UHF) band, L band, S band, C band, X band, $K_u$ band, K band, $K_a$ band, V band, W band, and millimeter wave bands) providing multiple band options for frequency channels. Further antenna radiation patterns and selection of antenna options or power levels may be adapted due physical proximity of other antenna systems, of a user with potential SAR exposure, or improvement of RF channel operation according to received signal strength indicator (RSSI), signal to noise ratio (SNR), bit error rate (BER), modulation and coding scheme index values (MCS), or data throughput indications among other factors. In some aspects the antenna adaptation controller may execute firmware algorithms or hardware to regulate operation of the one or more antenna systems 132 in the information handling system 100 to avoid poor wireless link performance due to poor reception, poor MCS levels of data bandwidth available, or poor indication of throughput due to indications of low RSSI, low power levels available (such as due to SAR), inefficient radiation patterns among other potential effects on wireless link channels used.

Various software modules comprising software application instructions 124 or firmware instructions may be coordinated by an operating system (OS) and via an application programming interface (API). An example operating system may include Windows®, Android®, and other OS types known in the art. Example APIs may include Win 32, Core Java API, Android APIs, or wireless adapter driver API. In a further example, processor 102 may conduct processing of mobile information handling system applications by the information handling system 100 according to the systems and methods disclosed herein which may utilize wireless communications. The computer system 100 may operate as a standalone device or may be connected such as using a network, to other computer systems or peripheral devices. In other aspects, additional processor or control logic may be implemented controllers located with radio modules or within a wireless adapter 120 to implement method embodiments of the antenna adaptation controller and antenna optimization according to embodiments herein. Code instructions 124 in firmware, hardware or some combination may be executed to implement operations of the antenna adaptation controller and antenna optimization on control logic or processor systems within the wireless adapter 120 for example.

In a networked deployment, the information handling system 100 may operate in the capacity of a server or as a client user computer in a server-client user network environment, or as a peer computer system in a peer-to-peer (or distributed) network environment. In a particular embodiment, the computer system 100 can be implemented using electronic devices that provide voice, video or data communication. Further, while a single information handling system 100 is illustrated, the term "system" shall also be taken to include any collection of systems or subsystems that individually or jointly execute a set, or multiple sets, of instructions to perform one or more computer functions.

The disk drive unit 116 may include a computer-readable medium 122 in which one or more sets of instructions 124 such as software can be embedded. Similarly, main memory 104 and static memory 106 may also contain computer-readable medium for storage of one or more sets of instructions, parameters, or profiles 124. The disk drive unit 116 and static memory 106 also contains space for data storage. Some memory or storage may reside in the wireless adapter 120. Further, the instructions 124 that embody one or more of the methods or logic as described herein. For example, instructions relating to the antenna adaptation system or antenna adjustments described in embodiments herein may be stored here or transmitted to local memory located with the antenna adaptation controller 134, antenna front end 125, or wireless module in radiofrequency subsystem 130 in the wireless interface adapter 120.

Battery 114 may be operatively coupled to a power management unit that tracks and provides power stat data 126. This power state data 126 may be stored with the instructions, parameters, and profiles 124 to be used with the systems and methods disclosed herein in determining antenna adaptation and antenna optimization in some embodiments. In other aspects, battery 114 may also be operatively coupled to a power source that may provide power to the information handling system or recharge battery 114 via a power management system.

The network interface device shown as wireless adapter 120 can provide connectivity to a network 128, e.g., a wide area network (WAN), a local area network (LAN), wireless local area network (WLAN), a wireless personal area network (WPAN), a wireless wide area network (WWAN), or other network. Connectivity may be via wired or wireless connection. Wireless adapter 120 may include one or more RF subsystems 130 with transmitter/receiver circuitry, modem circuitry, one or more unified antenna front end circuits 125, one or more wireless controller circuits such as antenna adaptation controller 134, amplifiers, antenna systems 132 and other radio frequency (RF) subsystem circuitry 130 for wireless communications via multiple radio access technologies. Each radiofrequency subsystem 130 may communicate with one or more wireless technology protocols. The radiofrequency subsystem 130 may contain individual subscriber identity module (SIM) profiles for each technology service provider and their available protocols for subscriber-based radio access technologies such as cellular LTE communications. The wireless adapter 120 may also include antenna systems 132 which may be tunable antenna systems or may include an antenna adaptation network for use with the system and methods disclosed herein to optimize antenna system operation. Additional antenna system adaptation network circuitry (not shown) may also be included with the wireless interface adapter 120 to implement WLAN or WWAN modification measures as described in various embodiments of the present disclosure.

In some aspects of the present disclosure, a wireless adapter 120 may operate two or more wireless links. In a further aspect, the wireless adapter 120 may operate the two or more wireless links with a single, shared communication frequency band such as with the concurrent frequency range 1 (FR1) sub-6 GHz or frequency range 2 (FR2) antenna 5G LTE standard WWAN operations in an example aspect. For example, a 5 GHz wireless communication frequency band may be apportioned under the 5G standards for communication on small cell WWAN wireless link operation as well as other wireless activity in LTE, WiGig, or other communication protocols. In some embodiments, the shared, wireless communication bands may be transmitted through one or a plurality of antennas. Other communication frequency bands are contemplated for use with the embodiments of the present disclosure as well.

In other aspects, the information handling system 100 operating as a mobile information handling system may operate a plurality of wireless adapters 120 for concurrent radio operation in one or more wireless communication bands or one wireless adapter 120 concurrently operating plural antennas 132. The plurality of antennas may operate in nearby wireless communication bands in some disclosed embodiments. Further, harmonics, environmental wireless conditions, and other effects may impact wireless link operation when a plurality of wireless links are operating as in some of the presently described embodiments. The series of potential effects on wireless link operation may cause an assessment of the wireless adapters 120 to potentially make antenna system adjustments according to the antenna adaptation control system of the present disclosure. Further, embodiments of antenna systems 132 described herein may co-locate a plurality of antenna systems 132 in a C-cover near a hinge formed between an A-cover and B-cover assembly and a C-cover and D-cover assembly of an information handling system. Embodiments herein describe a system design to minimize the impact of multiple wireless links operating concurrently in such systems by including an edge resonant isolator at the A-cover and placed near one of the plurality of antenna systems 132 to disrupt an electrical ground coupling path formed between the C-cover and D-cover assembly (i.e., base metal chassis) and A-cover and B-cover assembly (i.e., display metal chassis) at the hinge cavity and to be tuned in some embodiments to resonate for one or more target frequencies or harmonics.

The wireless adapter 120 may operate in accordance with any wireless data communication standards. To communicate with a wireless local area network, standards including IEEE 802.11 WLAN standards, IEEE 802.15 WPAN standards, WWAN such as 3GPP or 3GPP2, or similar wireless standards may be used. In some embodiments, the antenna systems may operate as 5G networks that implement relatively higher data transfer wavelengths within a frequency range 1 (RF 1) between 450 and 7,125 MHz and frequency range 2 (FR2) between 24,250 and 52,600 MHz. In some embodiments, the antenna systems may operate as 5G networks that implement relatively higher data transfer wavelengths such as high frequency (HF) band, very high frequency (VHF) band, ultra-high frequency (VHF) band, L band, S band, C band, X band, Ku band, K band, Ka band, V band, W band, and millimeter wave bands. Wireless adapter 120 and antenna adaptation controller 134 may connect to any combination of macro-cellular wireless connections including 2G, 2.5G, 3G, 4G, 5G or the like from one or more service providers. Utilization of radiofrequency communication bands according to several example embodiments of the present disclosure may include bands used with the WLAN standards and WWAN carriers which may operate in both licensed and unlicensed spectrums. For example, both WLAN and WWAN may use the Unlicensed National Information Infrastructure (U-NII) band which typically operates in the ~5 MHz frequency band such as 802.11 a/h/j/n/ac (e.g., center frequencies between 5.170-5.785 GHz). For example, in embodiments herein, one or more wireless adapters may control transceiving wireless signals in either millimeter-wave frequency bands such as 5G FR2, in sub-6 GHz frequency bands such as 5G FR1, or both. It is also understood that any number of available channels may be available under the shared communication frequency band in example embodiments. WLAN, for example, may also operate at a 2.4 GHz or a 5 GHz band. WWAN may operate in a number of bands, some of which are propriety but may include a wireless communication frequency band at approximately 2.5 GHz band for example. In additional examples, WWAN carrier licensed bands may operate at frequency bands of approximately 700 MHz, 800 MHz, 1900 MHz, or 1700/2100 MHz for example as well. In the example embodiment, mobile information handling system 100 includes both unlicensed wireless RF communication capabilities as well as licensed wireless RF communication capabilities. For example, licensed wireless RF communication capabilities may be available via a subscriber carrier wireless service. With the licensed wireless RF communication capability, WWAN RF front end may operate on a licensed WWAN wireless radio with authorization for subscriber access to a wireless service provider on a carrier licensed frequency band.

The wireless adapter 120 can represent an add-in card, wireless network interface module that is integrated with a main board of the information handling system or integrated with another wireless network interface capability, or any combination thereof. In an embodiment the wireless adapter 120 may include one or more RF subsystems 130 including transmitters and wireless controllers such as wireless module subsystems for connecting via a multitude of wireless links under a variety of protocols. In an example embodiment, an information handling system may have one or more antenna system transmitters 132 for 5G small cell WWAN, Wi-Fi WLAN or WiGig connectivity and one or more additional antenna system transmitters 132 for macro-cellular communication. The RF subsystems 130 include wireless controllers to manage authentication, connectivity, communications, power levels for transmission, buffering, error correction, baseband processing, and other functions of the wireless adapter 120.

The RF subsystems 130 of the wireless adapters may also measure various metrics relating to wireless communication pursuant to operation of an antenna system as in the present disclosure. For example, the wireless controller of a RF subsystem 130 may manage detecting and measuring received signal strength levels, bit error rates, signal to noise ratios, latencies, power delay profile, delay spread, and other metrics relating to signal quality and strength. Such detected and measured aspects of wireless links, operating on one or more antenna systems 132, may be used by the antenna adaptation controller to adapt the antenna systems 132 according to an antenna adaptation network according to various embodiments herein.

The wireless network may have a wireless mesh architecture in accordance with mesh networks described by the wireless data communications standards or similar standards in some embodiments but not necessarily in all embodiments. The wireless adapter 120 may also connect to the external network via a WPAN, WLAN, WWAN or similar wireless switched Ethernet connection. The wireless data communication standards set forth protocols for communications and routing via access points, as well as protocols for a variety of other operations. Other operations may include handoff of client devices moving between nodes, self-organizing of routing operations, or self-healing architectures in case of interruption.

In some embodiments, software, firmware, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

In accordance with various embodiments of the present disclosure, the methods described herein may be implemented by firmware or software programs executable by a controller or a processor system. Further, in an exemplary, non-limited embodiment, implementations can include distributed processing, component/object distributed processing, and parallel processing. Alternatively, virtual computer system processing can be constructed to implement one or more of the methods or functionalities as described herein.

While the computer-readable medium is shown to be a single medium, the term "computer-readable medium" includes a single medium or multiple media, such as a centralized or distributed database, and/or associated caches and servers that store one or more sets of instructions. The term "computer-readable medium" shall also include any medium that is capable of storing, encoding, or carrying a set of instructions for execution by a processor or that cause a computer system to perform any one or more of the methods or operations disclosed herein.

In a particular non-limiting, exemplary embodiment, the computer-readable medium can include a solid-state memory such as a memory card or other package that houses one or more non-volatile read-only memories. Further, the computer-readable medium can be a random-access memory or other volatile re-writable memory. Additionally, the computer-readable medium can include a magneto-optical or optical medium, such as a disk or tapes or other storage device to store information received via carrier wave signals such as a signal communicated over a transmission medium. Furthermore, a computer readable medium can store information received from distributed network resources such as from a cloud-based environment. A digital file attachment to an e-mail or other self-contained information archive or set of archives may be considered a distribution medium that is equivalent to a tangible storage medium. Accordingly, the disclosure is considered to include any one or more of a computer-readable medium or a distribution medium and other equivalents and successor media, in which data or instructions may be stored.

Figure 2:
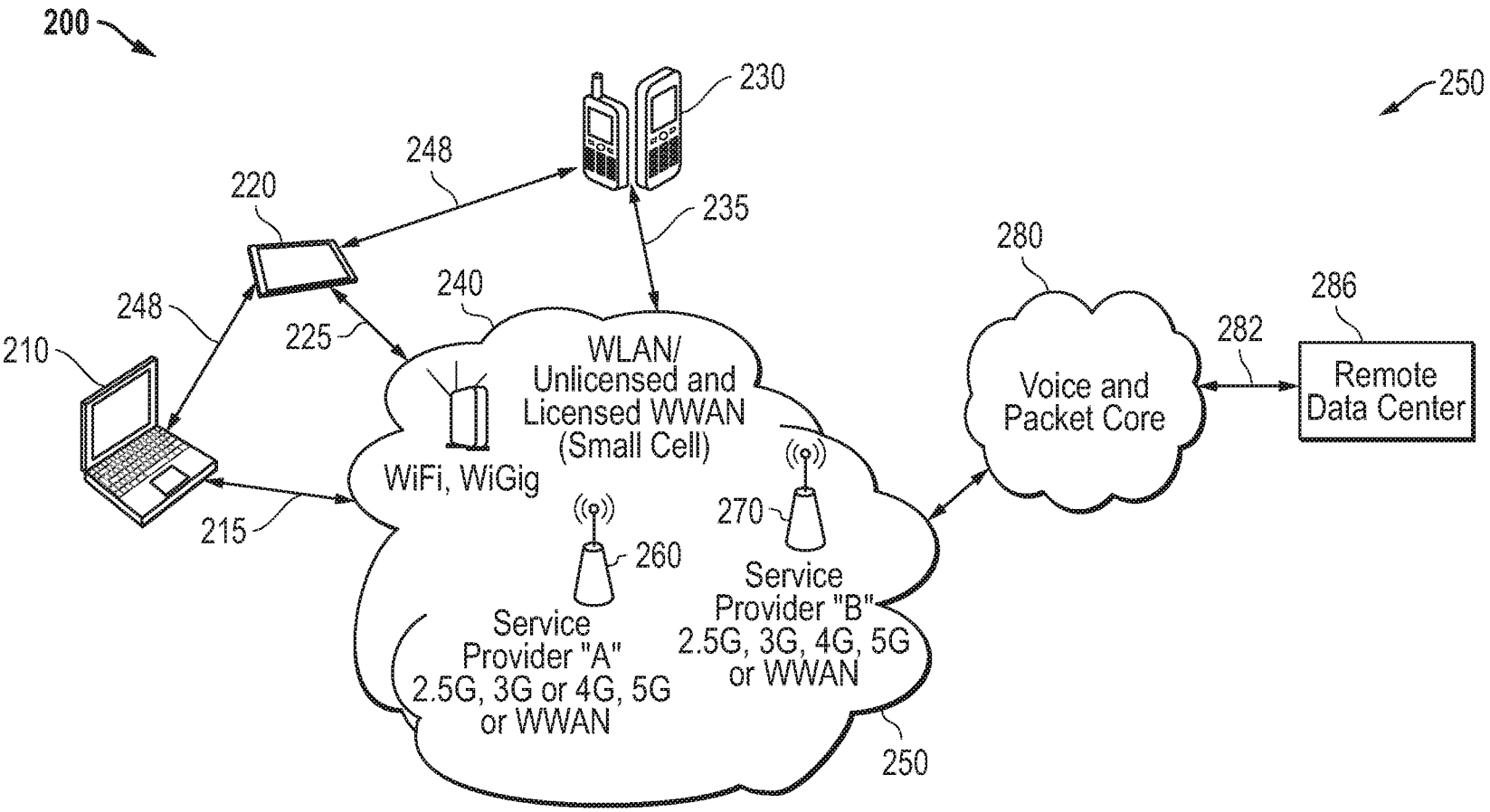
FIG. 2 is a block diagram of a network environment offering several communication protocol options and mobile information handling systems according to an embodiment of the present disclosure.

FIG. 2 illustrates a network 200 that can include one or more information handling systems 210, 220, 230. In a particular embodiment, network 200 includes networked mobile information handling systems 210, 220, and 230, wireless network access points, and multiple wireless connection link options. A variety of additional computing resources of network 200 may include client mobile information handling systems, data processing servers, network storage devices, local and wide area networks, or other resources as needed or desired. As partially depicted, systems 210, 220, and 230 may be a laptop computer, tablet computer, 360-degree convertible systems, wearable computing devices, a smart phone device or other computing devices. These mobile information handling systems 210, 220, and 230, may access a wireless local network 240, or they may access a macro-cellular network 250. For example, the wireless local network 240 may be the wireless local area network (WLAN), a wireless personal area network (WPAN), or a wireless wide area network (WWAN). In an example embodiment, LTE-LAA WWAN may operate with a small-cell WWAN wireless access point option.

Components of a wireless local network may be connected by wireline or Ethernet connections to a wider external network. For example, wireless network access points may be connected to a wireless network controller and an Ethernet switch. Wireless communications across wireless local network 240 may be via standard protocols such as IEEE 802.11 Wi-Fi, IEEE 802.11ad WiGig, IEEE 802.15 WPAN, or 5G small cell WWAN communications such as eNodeB, IEEE 802.11, IEEE 1914/1904, IEEE P2413/1471/42010, or similar wireless network protocols developed for 5G communications. Alternatively, other available wireless links within network 200 may include macro-cellular connections 250 via one or more service providers 260 and 270. Service provider macro-cellular connections may include 2G standards such as GSM, 2.5G standards such as GSM EDGE and GPRS, 3G standards such as W-CDMA/UMTS and CDMA 2000, 4G standards, or 5G standards including WiMAX, LTE, and LTE Advanced, LTE-LAA, small cell WWAN, and the like.

Wireless local network 240 and macro-cellular network 250 may include a variety of licensed, unlicensed or shared communication frequency bands as well as a variety of wireless protocol technologies ranging from those operating in macrocells, small cells, picocells, or femtocells.

In some embodiments according to the present disclosure, a networked mobile information handling system 210, 220, or 230 may have a plurality of wireless network interface systems capable of transmitting simultaneously within a shared communication frequency band. That communication within a shared communication frequency band may be sourced from different protocols on parallel wireless network interface systems or from a single wireless network interface system capable of transmitting and receiving from multiple antenna systems to enhance wireless data bandwidth. Similarly, a single antenna or plural antennas may be used on each of the wireless communication devices. Example competing protocols may be local wireless network access protocols such as Wi-Fi/WLAN, WiGig, and small cell WWAN in an unlicensed, shared communication frequency band. Example communication frequency bands may include unlicensed 5 GHz frequency bands or 3.5 GHz conditional shared communication frequency bands under FCC Part 96. Wi-Gig ISM frequency bands that could be subject to sharing include 2.4 GHz, 5 GHz and 60 GHz bands or similar bands as understood by those of skill in the art. For embodiments herein, 5G NR frequency bands such as FR1 (e.g., n1-n3, n5, n7, n8, n12, n14, n18, n20, n25, n28-n30, n34, n38-n41, n48, n50, n51, n65, n66, n70, n71, n74-n84, n86, n89, and n90) and FR2 (e.g., n257, n258, n260, and n261) bands may be transceived at the antenna or antennas. Within local portion of wireless network 250 access points for Wi-Fi or WiGig as well as small cell WWAN connectivity may be available in emerging 5G technology. This may create situations where a plurality of antenna systems are operating on a mobile information handling system 210, 220 or 230 via concurrent communication wireless links on both WLAN and WWAN or multiple concurrent wireless link to enhance bandwidth under a protocol and which may operate within the same, adjacent, or otherwise interfering communication frequency bands. The antenna may be a transmitting antenna that includes high-band, medium-band, low-band, and unlicensed band transmitting antennas. Alternatively, embodiments may include a single transceiving antennas capable of receiving and transmitting, and/or more than one transceiving antennas.

The voice and packet core network 280 may contain externally accessible computing resources and connect to a remote data center 286. The voice and packet core network 280 may contain multiple intermediate web servers or other locations with accessible data (not shown). The voice and packet core network 280 may also connect to other wireless networks similar to 240 or 250 and additional mobile information handling systems such as 210, 220, 230 or similar connected to those additional wireless networks. Connection 282 between the wireless network 240 and remote data center 286 or connection to other additional wireless networks may be via Ethernet or another similar connection to the world-wide-web, a WAN, a LAN, or other network structure. Such a connection 282 may be made via an access point/Ethernet switch to the external network and be a backhaul connection. The access point may be connected to one or more wireless access points before connecting directly to a mobile information handling system or may connect directly to one or more mobile information handling systems 210, 220, and 230. Alternatively, mobile information handling systems 210, 220, and 230 may connect to the external network via base station locations at service providers such as 260 and 270. These service provider locations may be network connected via backhaul connectivity through the voice and packet core network 280.

Remote data centers may include web servers or resources within a cloud environment that operate via the voice and packet core 280 or other wider internet connectivity. For example, remote data centers can include additional information handling systems, data processing servers, network storage devices, local and wide area networks, or other resources as needed or desired. Having such remote capabilities may permit fewer resources to be maintained at the mobile information handling systems 210, 220, and 230 allowing streamlining and efficiency within those devices. Similarly, remote data center permits fewer resources to be maintained in other parts of network 200.

Although 215, 225, and 235 are shown connecting wireless adapters of mobile information handling systems 210, 220, and 230 to wireless networks 240 or 250, a variety of wireless links are contemplated. Wireless communication may link through a wireless access point (Wi-Fi or WiGig), through unlicensed WWAN small cell base stations such as in network 240 or through a service provider tower such as that shown with service provider A 260 or service provider B 270 and in network 250. In other aspects, mobile information handling systems 210, 220, and 230 may communicate intra-device via 248 when one or more of the mobile information handling systems 210, 220, and 230 are set to act as an access point or even potentially an WWAN connection via small cell communication on licensed or unlicensed WWAN connections. Concurrent wireless links to information handling systems 210, 220, and 230 may be connected via any access points including other mobile information handling systems as illustrated in FIG. 2.

Figure 3A:
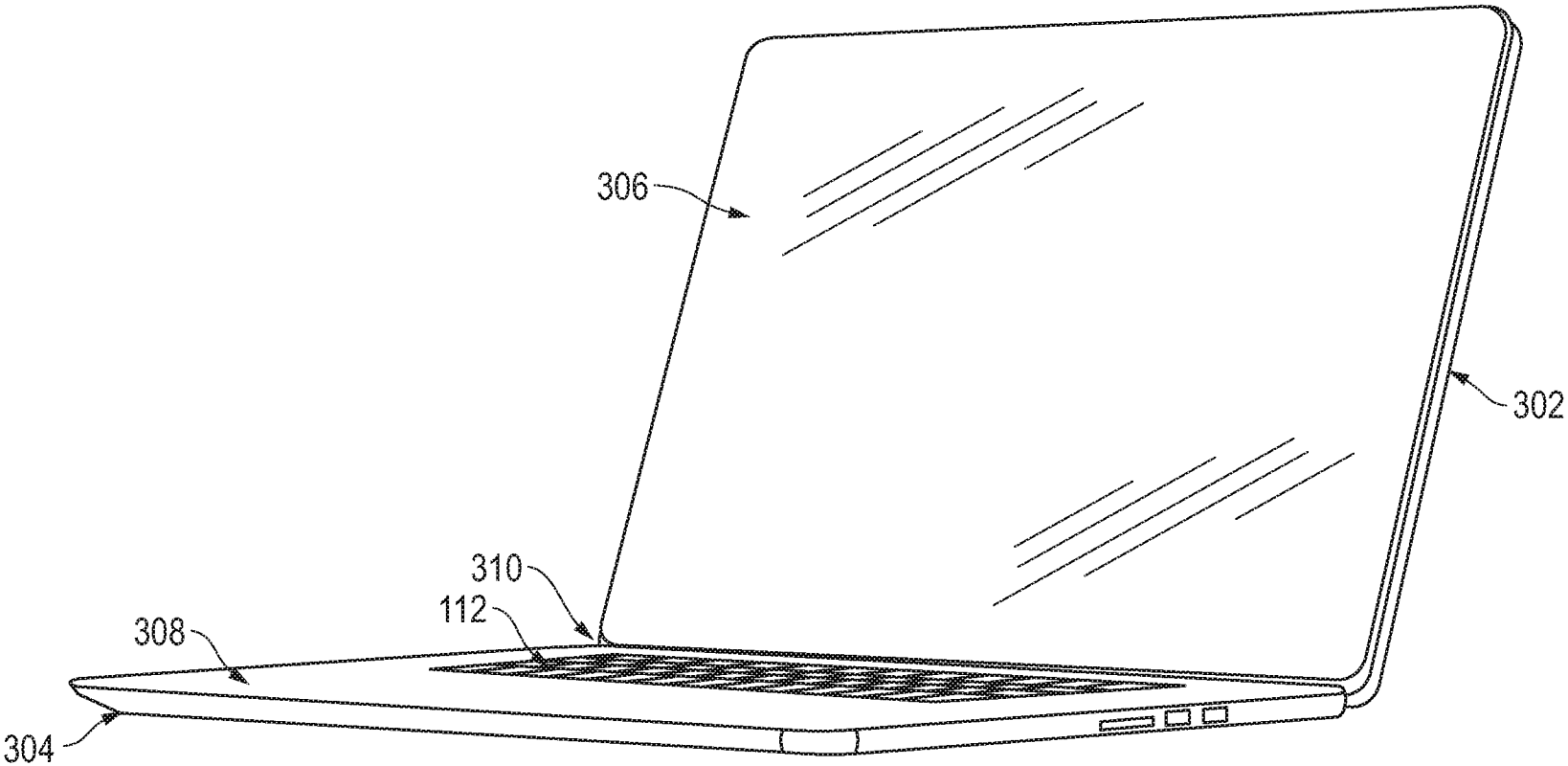
FIG. 3A is a graphical illustration of a metal chassis placed in an open configuration according to an embodiment of the present disclosure.

FIG. 3A is a graphical illustration of a metal chassis including a base chassis (including a C-cover 308 and D-cover 304) and lid chassis (including an A-cover 302 and B-cover 306) placed in a semi-closed configuration according to an embodiment of the present disclosure. The semi-closed configuration is shown for illustration purposes. It is understood that a closed configuration would have the lid chassis fully closed onto the base chassis. The metal chassis in an embodiment may comprise an outer metal case or shell of an information handling system such as a tablet device, laptop, or other mobile information handling system. As shown in FIG. 3A, the metal chassis, in an embodiment, may further include a plurality of chasses or cases such as a display chassis and a base chassis. For example, the metal chassis may further include the A-cover 302 functioning to enclose a portion of the information handling system as a display chassis. As another example, the metal chassis, in an embodiment, may further include a D-cover 304 functioning to enclose another portion of the information handling system along with a C-cover 308 or a base chassis which may include a plurality of transmitting/receiving antennas according to the embodiments described herein. The C-cover 308 may include, for example, a keyboard, a trackpad, or other input/output (I/O) device. As shown in FIG. 3A, when placed in the semi-closed configuration, the A-cover 302 forms a top outer protective shell, or a portion of a lid for the information handling system, while the D-cover 304 forms a bottom outer protective shell, or a portion of a base. As also can be seen in FIG. 3A, when in the fully closed configuration, the A-cover 302 and the D-cover 304 would be substantially parallel to one another.

In some embodiments, both the A-cover 302 and the D-cover 304 may be comprised of metal. In some embodiments, the A-cover 302 and D-cover 304 may include both metallic and plastic components. For example, plastic components that are radio-frequency (RF) transparent may be used to form a portion of the D-cover 304 where an edge resonant isolator is located next to which an RF transmitting antenna may be placed. According to some embodiments of the present disclosure, the edge resonant isolator prevents interference originating from the RF signals from other antenna elements interfering with those RF signals emitted by a first antenna element. Additionally, the edge resonant isolator may abate or eliminate resonances that are created by the excitation of the metal of the chassis by activation of the antenna elements. The structure of the edge resonant isolator may also counter any coupling currents originating from the C-cover 308 and D-cover 304 into the metal of the A-cover 302. In an example, an edge resonant isolator carve out of an edge of the A-cover 302 may lengthen the edge of the A-cover 302 to reduce propagation of any excitation currents down a hinge gap between the A-cover 302 and the D-cover 304. This ground current path created at the hinge and next to the insolating element allows for the redirection of excitation currents induced along the hinge so as to allow any antenna element to be co-located near the hinge without degradation of any RF signals emitted from the antenna. This, in turn, allows for the antenna or additional antennas to be placed within the information handling system and specifically at the C-cover 308 and D-cover 304 assembly close to the hinge. As a result of placing the antennas within the C-cover 308 and D-cover 304 assembly with the edge resonant isolator, the capabilities of information handling system may be increased while also increasing user satisfaction during use.

In an embodiment, the information handling system may include a plurality of antenna next to the hinge. In this embodiment, each of the individual antennas may emit an RF signal allowing for the ability of the information handling system to communicate a wider data bandwidth wirelessly on a variety of RATs. In an example, multiple frequencies may be emitted sequentially or concurrently so as to increase the ability of the information handling system to communicate as described herein. For example, some or all of a 4×4 LTE wireless system may deploy two or more concurrently operating antennas in the C-cover 302 along the hinge without inducing a hinge cavity mode causing interference.

In the embodiments described herein, the A-cover 302 may be movably connected to a back edge of the D-cover 304 via a hinge 310. The A-cover 302 may be operably connected to the hinge 310. In an embodiment, the hinge 310 may place a portion of the A-cover 302 close to a back side of the C-cover 308 and D-cover 304 assembly when the information handling system is in an open configuration as shown in FIG. 3A.

Figure 3B:
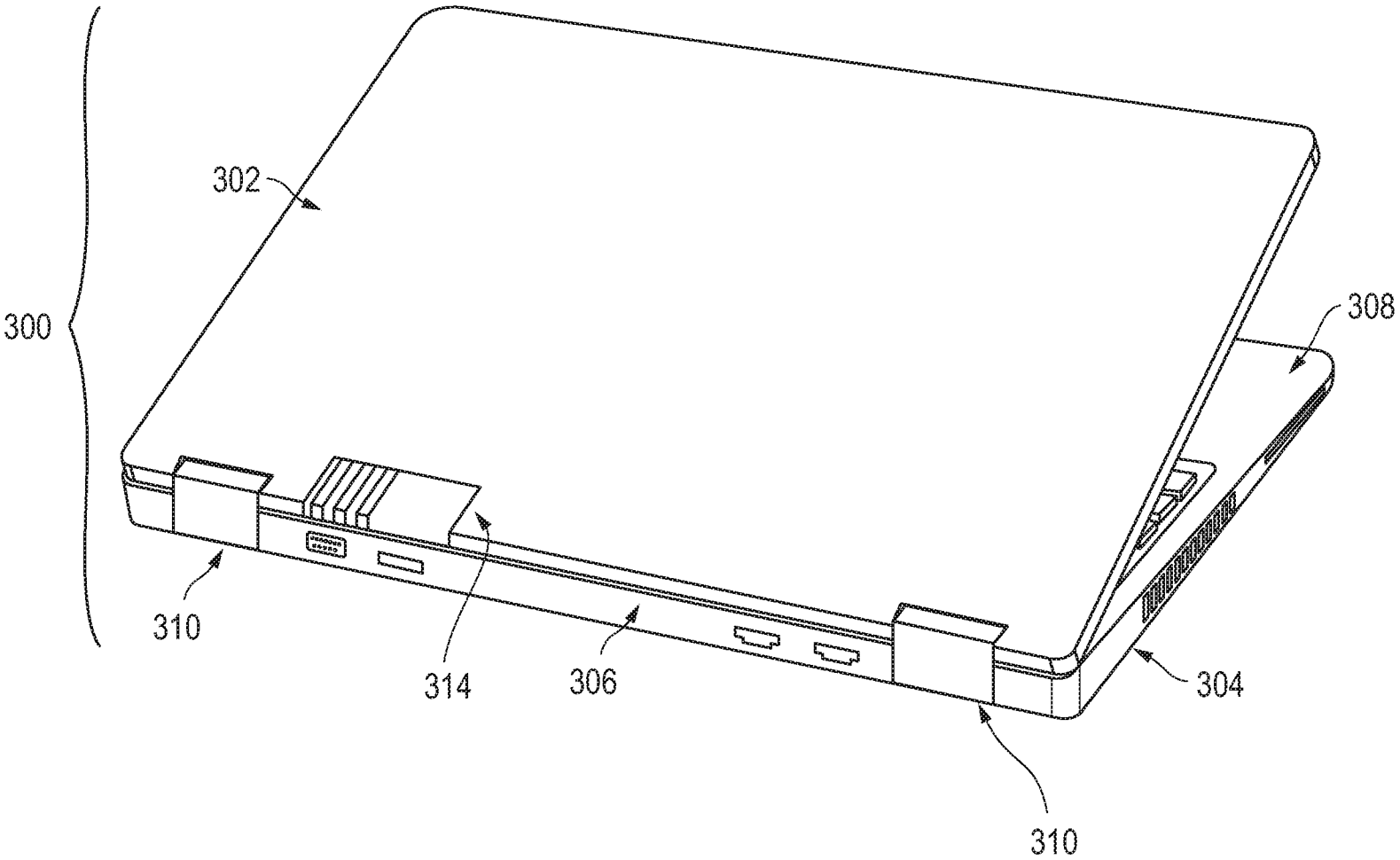
FIG. 3B is a graphical illustration of a metal chassis placed in a semi-closed configuration according to an embodiment of the present disclosure.

FIG. 3B is a graphical illustration of a metal chassis 300 placed in a semi-closed configuration according to an embodiment of the present disclosure. Specifically, FIG. 3B is a graphical illustration of a metal chassis 300 including a base chassis (including a C-cover 308 and D-cover 304) and display chassis (including an A-cover 302 and B-cover 306) placed in a semi-closed configuration according to an embodiment of the present disclosure. The metal chassis 300 in an embodiment may further comprise an outer metal case or shell of an information handling system for housing internal components of the information handling system, such as a video display, a cursor control device, and an alpha numeric input device. As shown in FIG. 3B, the metal chassis 300 may further include the B-cover 306 functioning to enclose the video or digital display device with the A-cover described herein. In an embodiment, the B-cover 306 may include a bezel while in other embodiments, the bezel is not present resulting from an increase in size of a display device. As another example, the metal chassis 300 may further include the C-cover 308 functioning to enclose a cursor control device and/or a keyboard acting as an alpha numeric input device. The A-cover 302 and the B-cover 306 may be joined together in an embodiment to form a fully enclosed display chassis, while the C-cover 308 and the D-cover 304 may be joined together to form a fully enclosed base chassis. Taking the closed configuration as a reference position of the lid chassis including the A-cover 302 and the B-cover 306 and the base chassis including the C-cover 308 and the D-cover 304, the lid chassis may be rotated away from the base chassis to an open configuration. For example, as shown in FIG. 3B, when placed in the open configuration, the lid chassis may be rotated away from the C-cover 308 and placed at an angle less than 180 degrees from the base chassis, such that a user may view the digital display within the B-cover 306 and interact with the cursor control device and/or keyboard within the C-cover 308.

FIG. 3B shows the presence of an edge resonant isolator 315 formed into or attached to the A-cover 302. The edge resonant isolator 315 may include a plurality of slits. In any example presented herein, the width of the slits and distance between the slits may be customized to create a multi-band, edge resonant isolator 315 that counters coupling resonant currents originating at the C-cover 308 and D-cover 304 and passing to the A-cover 302 to isolate from a hinge gap cavity mode causing interference with antennas located near the hinge gap between hinge elements 310. The multi-band isolating structure may be sized and spaced to be tuned to resonate at one or more target RF bands or harmonics thereof. In these embodiments, the edge resonant isolator 315 may act as a resonant cavity in order to increase the RF transceiving abilities of one or more antenna elements located along a back edge of C-cover 308 or D-cover 304 near the hinge gap. The length of the slits, the width of the slits, and/or the spacing between the slits formed at or in the A-cover 302 of the edge resonant isolator 315 may be modulated and tuned to resonate one or more target RF band during activation of an antenna element placed in the C-cover 308 or D-cover 304 next to the edge resonant isolator 315. Any pattern of narrower and/or wider slits may be included in order to decouple high bands and mid-LTE bands respectively that may originate from the RF emissions from plurality of antenna elements. Further the location of slits in the A cover may be placed strategically relative to any antenna element in order to radiate a fundamental excitation mode for any target RF band of one or more antennas.

As shown in FIG. 3B, the edge resonant isolator 315 may conform with a shape of the A-cover 302. In this example, the A-cover 302 drops down towards the C-cover 308 and D-cover 304 towards the back creating an aesthetically appealing metal chassis. In a closed configuration, the A-cover 302 creates a downward slopping face towards the hinge 310 and may meet an edge of the C-cover 308 and D-cover 304. In any of the embodiments described herein, the edge resonant isolator 315 may be formed to conform to the slope or bevel formed on the edge of the A-cover 302 so that the look and feel of this slope or bevel formed in the A-cover 302 remains constant.

In an embodiment, the edge resonant isolator 315 may be cut out of the A-cover 302. Any cutting process may be used to form the plurality of slits within the A-cover 302. In an embodiment, the edge resonant isolator 315 may be a pronged, stamped metal piece that is operatively coupled to the A-cover 302 with the prongs spaced to form prongs for the slits of edge resonant isolator 315. In these embodiments, the edge resonant isolator 315 formed on the A-cover 302 may be made of a metal that sufficiently conducts electrical currents along a longer A-cover 302 edge to isolate plural antennas and prevent interference originating from the RF signals from the antenna elements from interfering with each other by abating or eliminating resonant currents that are created by the excitation of the metal of the chassis by activation of the antenna elements. This counteracts any coupling currents originating from the C-cover 308 and D-cover 304 into the metal of the A-cover 302 to propagate down a hinge gap as a destructive hinge cavity mode as described herein. The edge resonant isolator 315 may also be tuned to create a resonant cavity in order to increase the RF transceiving abilities of the antenna element. In an embodiment, the A-cover 302 includes a cut out with a prong stamped metal piece attached and spaced to form prongs for the slits of edge resonant isolator 315.

In an embodiment, the edge resonant isolator 315 cut out of the A-cover 302 may have an insert molded into the slits formed or over the formed slits. The insert may be compression molded to cause the plastic to also conform to the slope or bevel formed in the edge of the A-cover 302. The insert may be made of any RF transparent material such as a plastic. When the insert is formed over or within the slits, the insert may have a color added to it to visibly hide the presence of the insert. By coloring the insert to match the A-cover 302, the aesthetics of the information handling system are maintained.

In an embodiment, part of the edge resonant isolator 315 may be formed of a separate pronged piece of metal to form prongs in the cut-out of the A-cover 302. In this embodiment, the edge resonant isolator 315 formed out of a separate piece of metal may be stamp pressed or spot welded to the A-cover 302 at a location where a portion of the A-cover 302 has been cut away and form an operative, conductive coupling. By making the edge resonant isolator 315 out of a separate piece of metal apart from the A-cover 302, the separate piece of metal may be stamped and the prong sized or spaced as described for the antennas deployed edge resonant isolator. This is a less expensive process and allows for various metallic prong sets to be used and sized or spaced with the A-cover cut out to form the edge resonant isolator 315. This provides flexibility in selecting antennas or operating frequencies used among various information handling system product lines which may share a similar chassis. In this embodiment, the edge resonant isolator 315 may have a plastic insert molded over or into the slits formed by the pronged metal piece operatively coupled in the cut-out of the A-cover edge. The insert may be compression molded to cause the plastic to also conform to the slope formed in the edge of the A-cover 302.

Figure 3C:
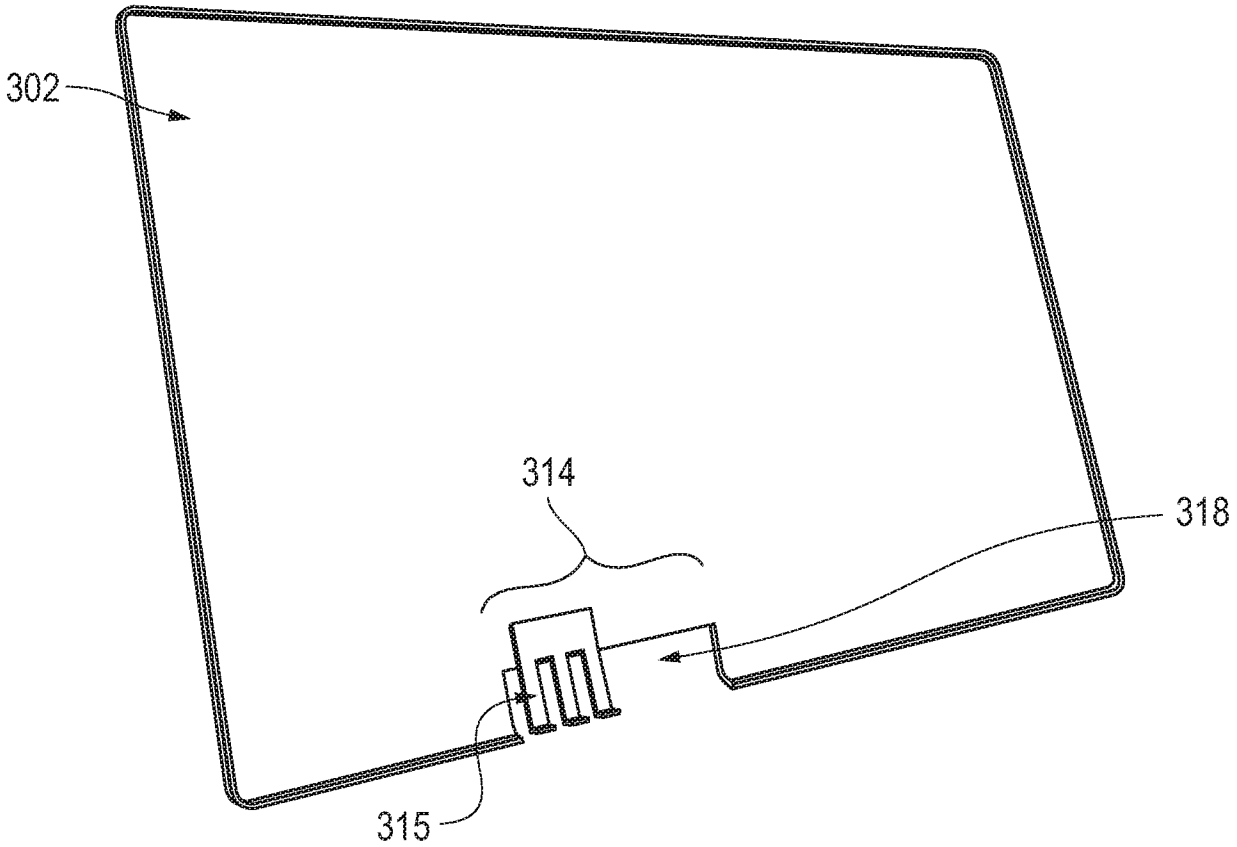
FIG. 3C is a graphical illustration of an A-cover of an information handling system according to an embodiment of the present disclosure.

FIG. 3C is a graphical illustration of an A-cover 302 of an information handling system according to an embodiment of the present disclosure. The A-cover 302, in this embodiment, has had a window portion 318 cut out from a back edge of the A-cover 302. The window portion 318 may be cut away from the A-cover 302 along an edge using any type of cutting process or machinery. According to the embodiment shown in FIG. 3C, the edge resonant isolator 315 may be made of a pronged piece of metal apart from that used to for the A-cover 302. In an example, the type of metal the A-cover 302 is made of may be different from the type of metal the edge resonant isolator 315 is made of. The pronged piece of metal may be stamped to any size and spacing. The pronged piece of metal may be further located and operatively coupled within window 318 to tune the edge resonant isolator 315 for cavity resonance in support of one or more antennas.

In various examples herein, slits formed among the prongs of the pronged piece of metal may be sized and spaced to tune the edge resonant isolator 315 with respect to isolation characteristics as well as with respect to resonant characteristics with respect to the nearby antenna in the C-cover. For example, the slits formed among the prongs 315 and edges of the window cut-out 318 of the edge resonant isolator 315 may be of varying sizes to make the edge resonant isolator capable of isolation for a variety of frequency bands. In an embodiment, the area 314 of the window cut-out 318 may help to define operative characteristics of the edge resonant isolator 315. The area 314 (length and width) of the edge resonant isolator 315 may be tuned to have a specific length of electric current path along with the edge resonant isolator 315. In an embodiment, the area 314 (length and width) may be tuned to get a specific length of electric current path that is part of an electrical path along edges of the prongs of the edge resonant isolator 315. In these embodiments, the A-cover 302 is made of a metal and forming a break within that metal that has a certain are 314, a molded plastic may be used to form the isolator within the A-cover 302 without the area 314 and edge resonant isolator 315 being exposed. The varied sizes of the window 318 and edge resonant isolator 315 may also assist in accommodating resonance of the nearby antenna in the hinge cavity. For example, a first set of narrow slits and a second set or relatively wider slits to decouple high band frequencies from lower-band frequencies respectively. In an aspect as shown, narrow slits may be formed among the prongs 315 at the left of the cut-out window 318 of the edge resonant isolator 315 while a wider slit or gap may be left on the right side of the edge resonant isolator 315 as viewed in the embodiment of FIG. 3C. Other variations of slit width will impact the isolation and the localized resonance of radiofrequencies emitted by the antennas located near the hinge gap. For example, the sizing of the slits formed in the edge resonant isolator 315 may also be tuned to contain an RF EM field distribution at the edge resonant isolator in the hinge gap to assist transceiving radio frequency signals at one or both antennas along the hinge gap.

The edge resonant isolator pronged piece of metal 315 may be affixed to an interior surface of the A-cover 302. The method of affixing the edge resonant isolator 315 to the A-cover 302 may include metal welding, sonic welding, compression welding, or via implementation of a fastening device such as a screw or bolt. The present disclosure, however, contemplates that other fastening or affixing processes may be employed in order to secure the edge resonant isolator 315 to the A-cover 302 as well as provide electrical coupling to the edge of the C-cover 302. In a specific embodiment, an insert (not shown) used to hide the presence of the edge resonant isolator slit at the A-cover 302 may be used to affix the pronged piece of metal 315 against the A-cover 302 during, for example, a compression molding process.

As described herein, the edge resonant isolator 315 may be placed at a location on the A-cover 302 relative to a first antenna element. The plurality of slits formed into the edge resonant isolator 315 by the pronged piece of metal 315 to create a multi-band, resonant cavity near the hinge that increases the RF transceiving abilities of the antenna element while countering or abating any coupling currents originating at the C-cover 308 and D-cover 304 that pass to the metallic A-cover 302 further along a hinge gap to avoid a destructive cavity mode. In an example, the coupling currents originating at the C-cover 308 and D-cover 304 may pass across the hinge 310 and to the A-cover 302 with the edge resonant isolator 315 that forms a current path formed up and down the metal prongs of the plurality of slits. The currents may be allowed to travel up and down each of the slits formed into the edge resonant isolator 315 thereby also increasing the RF field distribution at the first antenna and isolating, as the currents diminish, the RF emissions between a first antenna and RF emissions from a second antenna also placed near the hinge 310. By causing the coupling current to travel up and down the plurality of slits in the edge resonant isolator 315, the size of the slits in the edge resonant isolator 315 may be modulated and tuned to resonate at a target frequency of at least one of the antennas near the edge resonant isolator 315. Also, by placing the edge resonant isolator 315 closer to a first antenna than a second antenna, the RF emissions from each of the antennas may be decoupled. For example, RF EM emissions from the first antenna (i.e., high band RF EM waves) and RF EM emissions from the second antenna (i.e., mid-LTE band RF EM waves) or any RF EM waves emitted from either of the first and second antennas may be decoupled.

In an embodiment, the size and shape of the edge resonant isolator 315 as well as the size and shape of the plurality of slits formed in the edge resonant isolator 315 may be customized based on a target frequency to be resonated from an antenna in the base chassis across from the edge resonant isolator 315.

Figure 3D:
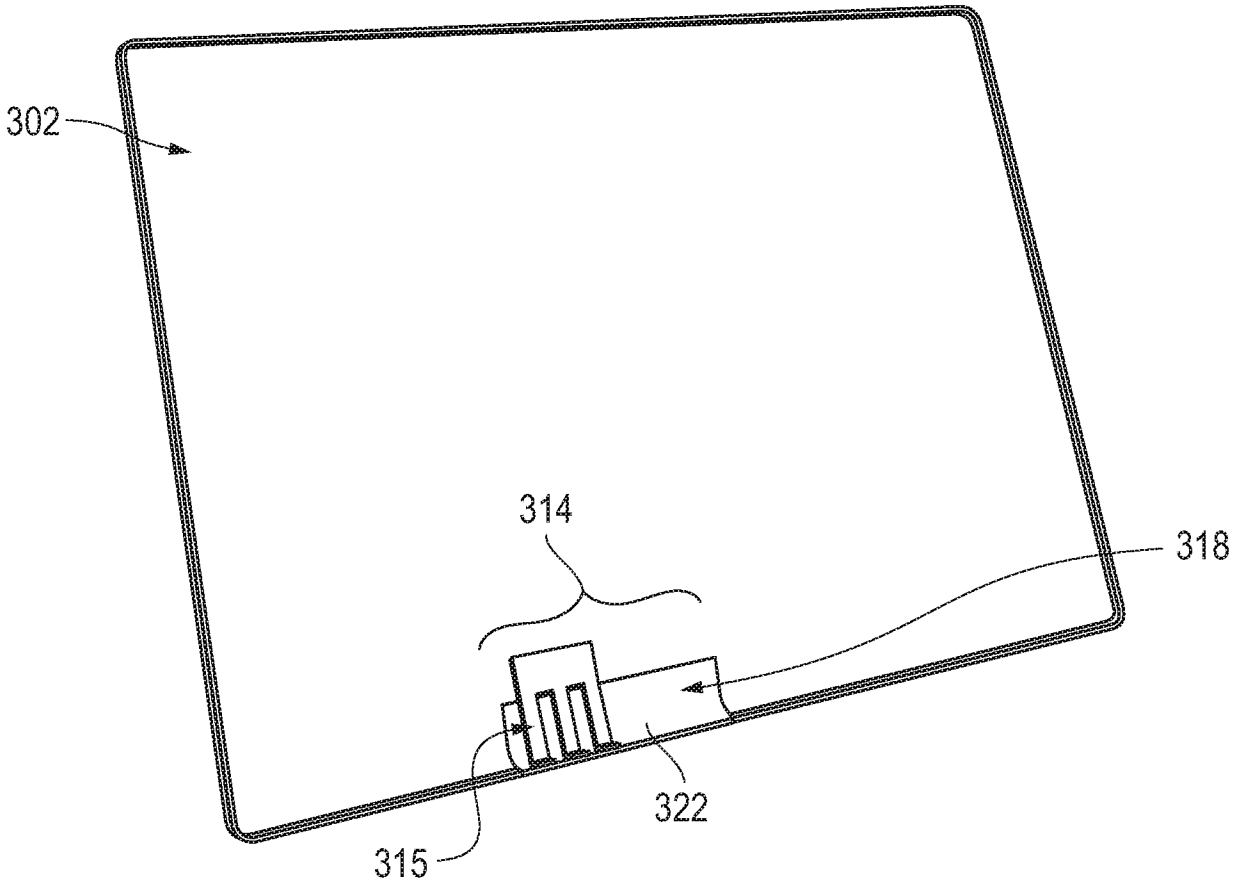
FIG. 3D is a graphical illustration of an A-cover of an information handling system according to another embodiment of the present disclosure.

FIG. 3D is a graphical illustration of an A-cover 302 of an information handling system according to another embodiment of the present disclosure. The embodiment shown in FIG. 3D, the window portion 318 and the slits formed by the pronged piece of metal 315 of the edge resonant isolator 315 have been filled with a molded insert 322 within the area 314 defined by the window portion 318. In an embodiment, the molded insert 322 is a molded plastic support that fits into the window portion 318 and secures the distal ends of the pronged piece of metal 315 edge resonant isolator from moving perpendicular to an exterior or interior surface of the A-cover 302. In the embodiment shown in FIG. 3D, the molded insert 322 may be formed to align with a sloped or beveled surface of the A-cover 302. In an embodiment, during manufacture of the information handling system, the molded insert 322 may be compression molded to fit within the window portion 318 and conform to the interior and/or exterior surfaces of the A-cover 302. In an embodiment, the molded insert 322 may be fit over the pronged piece of metal of the edge resonant isolator 315 to support it. Although the present disclosure describes the formation of the molded insert 322 using compression molding, the present disclosure contemplates the use of other manufacturing techniques to form the molded insert 322 into the window portion 318.

The molded insert 322 may be made of any RF transparent material. In the embodiments disclosed herein, the molded insert 322 is made of a plastic that is transparent to RF EM waves emitted by a first antenna while still allowing the slits of the edge resonant isolator 315 to resonate as described herein. Although the present disclosure describes the molded insert 322 as being made of plastic, the present disclosure also contemplates the use of other types of RF transparent materials and the description of the molded insert 322 being made of plastic is not meant to be limiting the disclosure in any way.

Figure 3E:
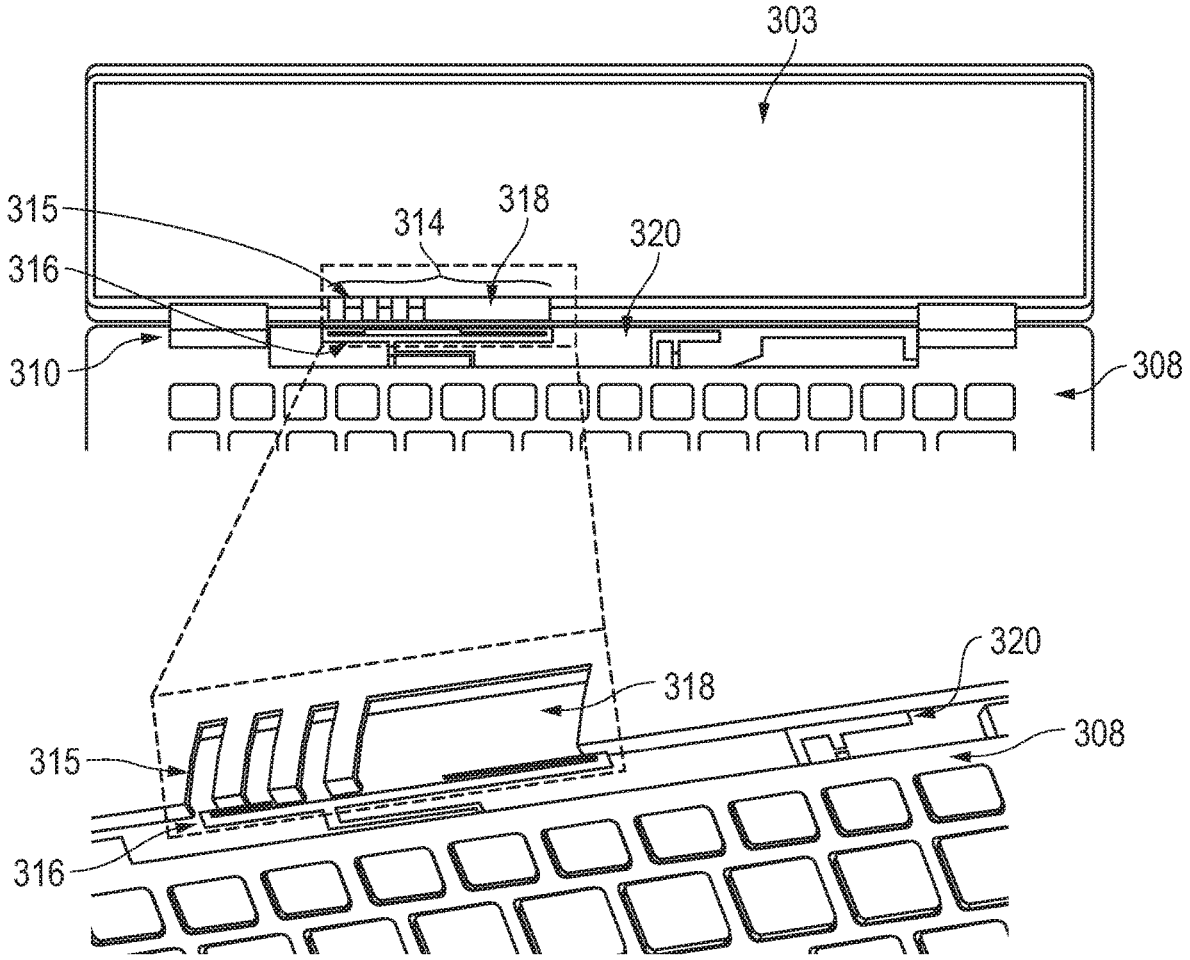
FIG. 3E is a top graphical illustration and an exploded view of a plurality of antennas located within a C-cover according to an embodiment of the present disclosure.

FIG. 3E is a top graphical illustration and an exploded view of a plurality of antennas 316, 320 located within a C-cover 308 and near a hinge according to an embodiment of the present disclosure. Although the present disclosure describes the antennas 316, 320 as being formed close to the hinge 310, the present specification contemplates the placement of other antennas at other locations within the C-cover 308 and D-cover 304 assembly. In an embodiment, a first antenna 316 is placed close to the edge resonant isolator 315. The placement of the antennas 316, 320 may be selected so that the edge resonant isolator 315 may be allowed to disrupt an electrical ground coupling path formed between the base metal chassis (i.e., the C-cover 308 and D-cover 304 assembly) and display metal chassis (i.e., the A-cover 302 and B-cover 306 assembly) at, for example, a cavity formed within the hinge gap as described herein.

The embodiment shown in FIG. 3E shows a first antenna 316 formed within the C-cover 308 near the hinge gap placed alongside a second antenna 320 also within the C-cover 308 near the hinge gap, but further along the back edge of C-cover 308. The first antenna 316 and second antenna 320 may be any type of RF EM radiating device. In an embodiment, each of the first antenna 316 and second antenna 320 may be a monopole antenna such as a planar wire antenna that receives a current from, for example, an antenna front end or other antenna controlling device. Upon receipt of the current at a voltage the monopole antenna may radiate an RF EM wave at a specific frequency based on the length of the monopole antenna. In another embodiment, the first antenna 316 and second antenna 320 may be an aperture antenna. In this embodiment, any edges of the aperture may act as RF excitable structures such that the edges emit the RF EM waves at the frequency the antenna element is formed to emit. Each of the first antenna 316 and second antenna 320 may be electrically coupled to a grounding source.

As described herein, during activation of the first antenna 316, the edge resonant isolator 315 with the prongs 315 and window 318 may lengthen the edge of the A-cover along the hinge gap. This may contain propagation of a destructive hinge gap cavity mode down the hinge gap. The edge resonant isolator 315 may also create a resonant cavity near the hinge gap to resonate at a target RF band of the first antenna 316 based on the size (i.e., length and width) as spacing of the slits formed of the prongs 315 in the edge resonant isolator 315. Concurrently or subsequently, the second antenna 320 may be activated. In the embodiments presented herein, upon activation of the second antenna 320, the edge resonant isolator 315 with its plurality of slits formed by the metallic prongs 315 decouple the individual RF EM waves emitted by the first antenna 316 from the second antenna 320 and visa-versa. By way of example, the first antenna 316 may emit a HF band or a higher frequency while the second antenna 320 may emit a RF lower than a HF band. In other example embodiments, the first antenna 316 may operate on different channels in the same or similar band such as those channels used in other antennas of a 4×4 LTE wireless system. This may include two antennas 316, 320 operating on a FR1 band, two antennas 316, 320 operating on a FR2 band, the first antenna 316 operating on a FR1 band with the second antenna 320 operating on an FR2 band, etc. among other various combinations in embodiments herein. The edge resonant isolator 315 may, therefore, isolate the HF band emitted by the first antenna 316 from channels of the second antenna 320 or from the lower frequency bands emitted by the second antenna 320 thereby allowing, in some embodiments, for the concurrent transmission of multiple RF signals from the information handling system. In an embodiment, the length of the first antenna 316 and the second antenna 320 may cause these two antennas 316, 320 to operate at any same, overlapping, or different frequency bands. By way of example, the first antenna 316 may operate at low-, mid-, and high-bands while the second antenna 320 may operate at mid- and high-bands. In this example, the operation bands may not be the same for the first antenna 316 and second antenna 320, but both antennas 316, 320 may support exactly mid- and high-bands (e.g., bands 1/2/3/4/7/25/30/34/38/39/40/41/42/43/66). Where the operation frequencies (bands) is different between the first antenna 316 and second antenna 320, the edge resonant isolator 315 may not be used. However, when there are same operation frequencies (bands) between the second antenna 320 and first antenna 316, the edge resonant isolator 315 improves isolation in certain frequencies where both antennas operate concurrently. These various embodiments increase the flexibility of the communication capabilities of the information handling system without experiencing a degradation in signal strength of the any of the first antenna 316 and second antenna 320. In an embodiment, the placement of the edge resonant isolator 315 eliminates the use of a separate isolating device within the hinge 310 or C-cover 308 thereby increasing the footprint within the hinge 310 to act as a resonant cavity.

Figure 3F:
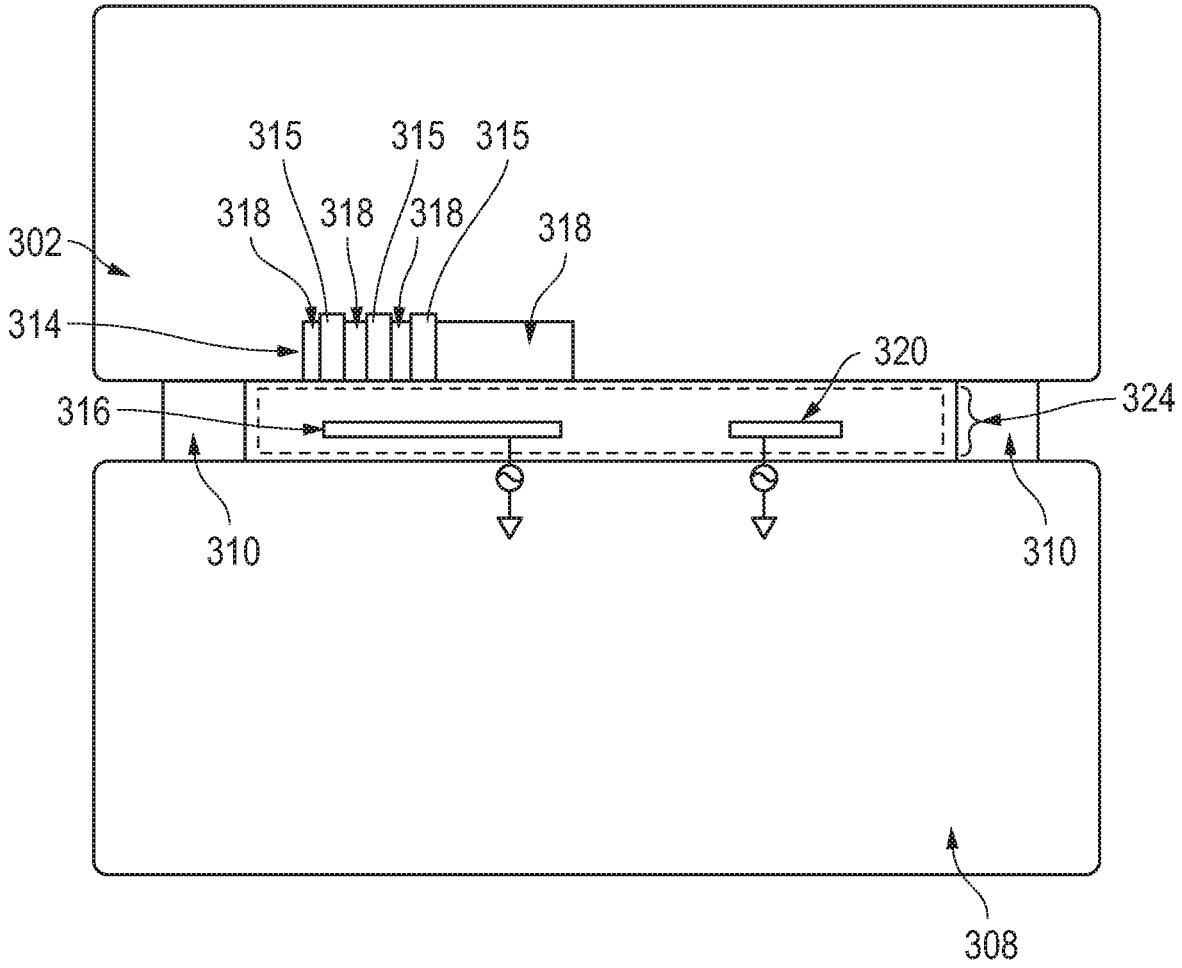
FIG. 3F is a block diagram of an information handling system including two antenna elements and an edge resonant isolator in a C-cover according to an embodiment of the present disclosure.

FIG. 3F is a block diagram of an information handling system including two antenna elements 316, 320 and an edge resonant isolator 315 near a hinge 310 and hinge cavity 324 formed according to an embodiment of the present disclosure. In the embodiment shown in FIG. 3F, the hinge 310 may have a cavity 324 formed of the hinge gap between the A-cover 302 and the C-cover 308 and D-cover therein. In an embodiment, the hinge 310 may be any type of hinge 310 that allows for the placement of the first antenna 316 and second antenna 320 in or under the C-cover 308 near the hinge 310 and hinge cavity 324.

In the embodiment shown in FIG. 3F, the edge resonant isolator 315 may be used to disrupt an electrical ground coupling path formed between the C-cover and D-cover assembly and A-cover and B-cover assembly at the hinge cavity 324. In this embodiment, during activation of either or both of the first antenna 316 and second antenna 320, the RF EM waves emitted may cause excitation of the metal components of the information handling system such as the A-cover 302, B-cover 306, C-cover 308, and D-cover 304. The electrical currents created by the RF EM waves interacting with these metallic components and covers cause the current to pass across the cavity 324 and to the A-cover 302. The edge resonant isolator 315 with its plurality of slits formed of metal prongs 315 and window 318 in the A-cover may counter these currents created between the base chassis and display chassis. Edge resonant isolator 315 effectively lengthens the edge of A-cover 302 thus containing the surface currents along that edge and isolating the antennas 316 and 320 from a cavity mode propagating further down hinge cavity 324. In other systems, co-located antennas placed close to each other that have overlapping RF bands may interfere with each other via, for example, a motherboard ground currents coupling path over which the antennas are excited or via this cavity mode propagation along the hinge cavity 324. In a particular example, when LTE antennas are co-located in the C-cover 308 and D-cover 304 assembly next to a hinge, ground currents created via activation of the antennas may couple through the hinge 310 into the metal A-cover 302 and pass back to the other antenna. This would result in the hinge cavity 324 resonant mode that dominates even when compared to the antenna coupling via the motherboard. The edge resonant isolator 315 of the present embodiments, however, prevents this coupling along the hinge cavity 324 thereby preventing such interference between the first antenna 316 and second antenna 320 while also acting as a resonant cavity by containing resonance to the cavity near the first antenna 316 in order to increase the RF transceiving abilities of the first antenna 316.

Figure 4:
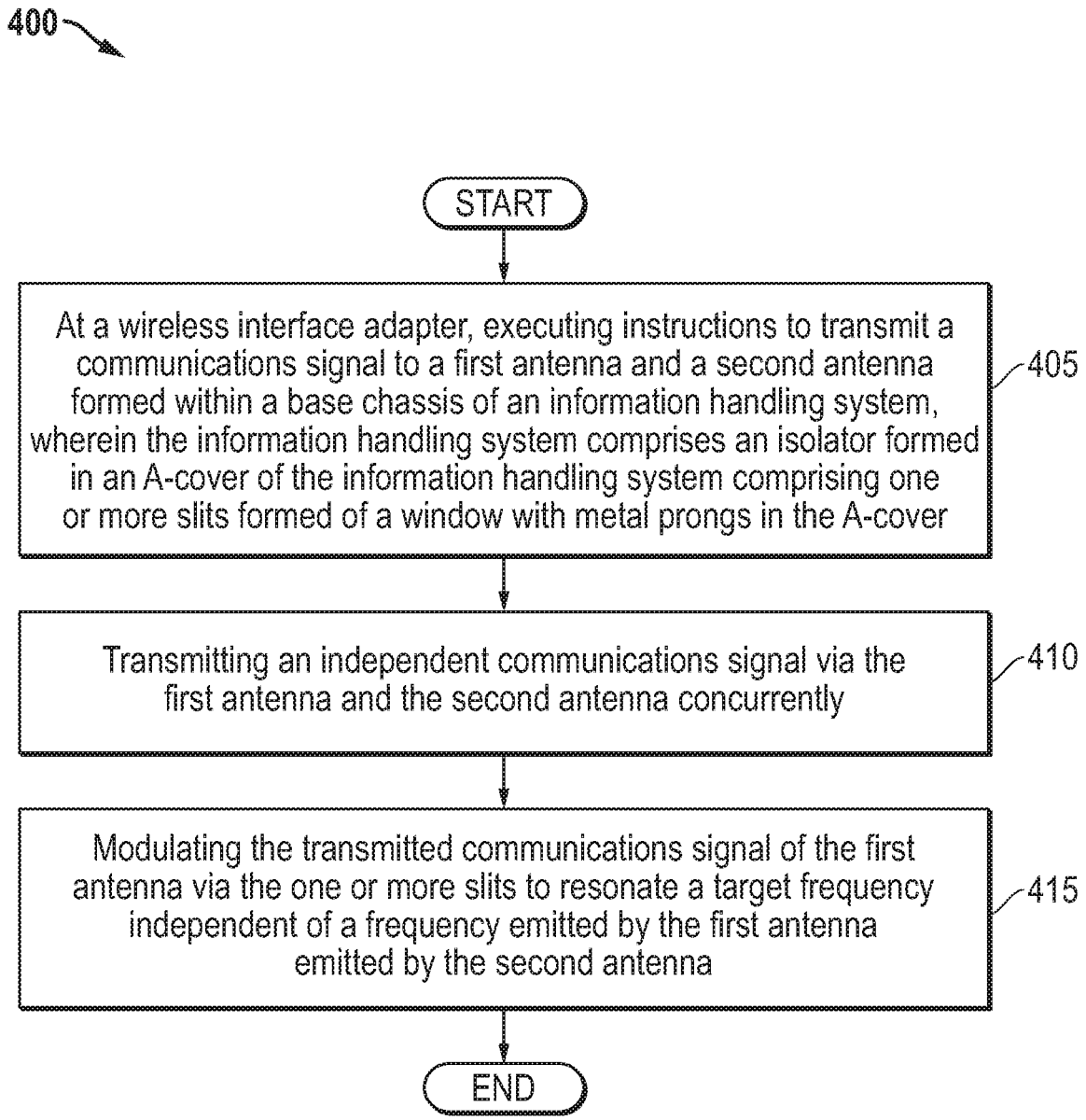
FIG. 4 is a flow diagram illustrating a method for operating an information handling system having a plurality of antennas within a C-cover near a hinge according to an embodiment of the present disclosure.

FIG. 4 is a flow diagram illustrating a method for operating an information handling system having a plurality of antennas within a C-cover of an information handling system near a hinge according to an embodiment of the present disclosure. The method 400 may include, at block 405, executing instructions at a wireless interface adapter to transmit a communications signal to a first antenna and a second antenna formed within a base chassis of an information handling system, wherein the information handling system comprises an isolator formed in an A-cover of the information handling system comprising one or more slits formed of a window with metal prongs in the A-cover. In an embodiment, these instructions may be executed by an antenna adaption controller associated with the wireless interface adapter. In an embodiment, the execution of these instructions may be completed partially by the processor of the information handling system and antenna adaption controller. In either example, the execution of the instructions causes a current or currents at certain voltages to be applied to the first antenna and a second antenna. The first and second antennas may be monopole antennas placed within the C-cover near a hinge cavity gap of the information handling system. As described herein, the signals sent to the antennas may cause electromagnetic waves in any range or a target range of a RF on the EM spectrum including the FR1 and FR2 5G bandwidths described herein.

At block 410, independent communication signals in the form of RF EM waves may be transmitted via the first antenna and second antenna. As described herein, the transmitted RF EM waves may be concurrently emitted by the first and second antennas. The specific arrangement of the antennas relative to the edge resonant isolator allows for each RF EM wave to not interfere with each other.

In some embodiments, other antennas may be deployed on the information handling system elsewhere. In particular embodiments, multiple antenna, including those disposed along the hinge cavity gap, mor form a 4×4 LTE antenna system. Such a 4×4 LTE antenna system may enable data rate capabilities wirelessly to reach 5G gigabyte levels such as used with WiGig or other protocols.

At block 415, the method 400 may continue with modulating the transmitted communications signal of the first antenna via the one or more slits to resonate a target frequency emitted by the first antenna independent of a frequency emitted by the second antenna. As described herein, the length of the slits, the width of the slits, and/or the spacing between the slits formed at the edge resonant isolator or in the A-cover may be modulated and tuned to resonate in a target RF band during activation of an antenna element placed across from or next to the edge resonant isolator along the hinge cavity. Any pattern of narrower and/or wider slits may be included in order to decouple high bands and mid-LTE bands respectively that may originate from the RF emissions from a plurality of antenna elements. Further the location of slits formed by metal prongs and a window in the edge of the A-cover may be placed strategically relative to any antenna element in order to radiate a fundamental excitation mode for any target RF band (e.g., middle bands such as 1/2/3/4/25/34/39/66, among others).

Figure 5:
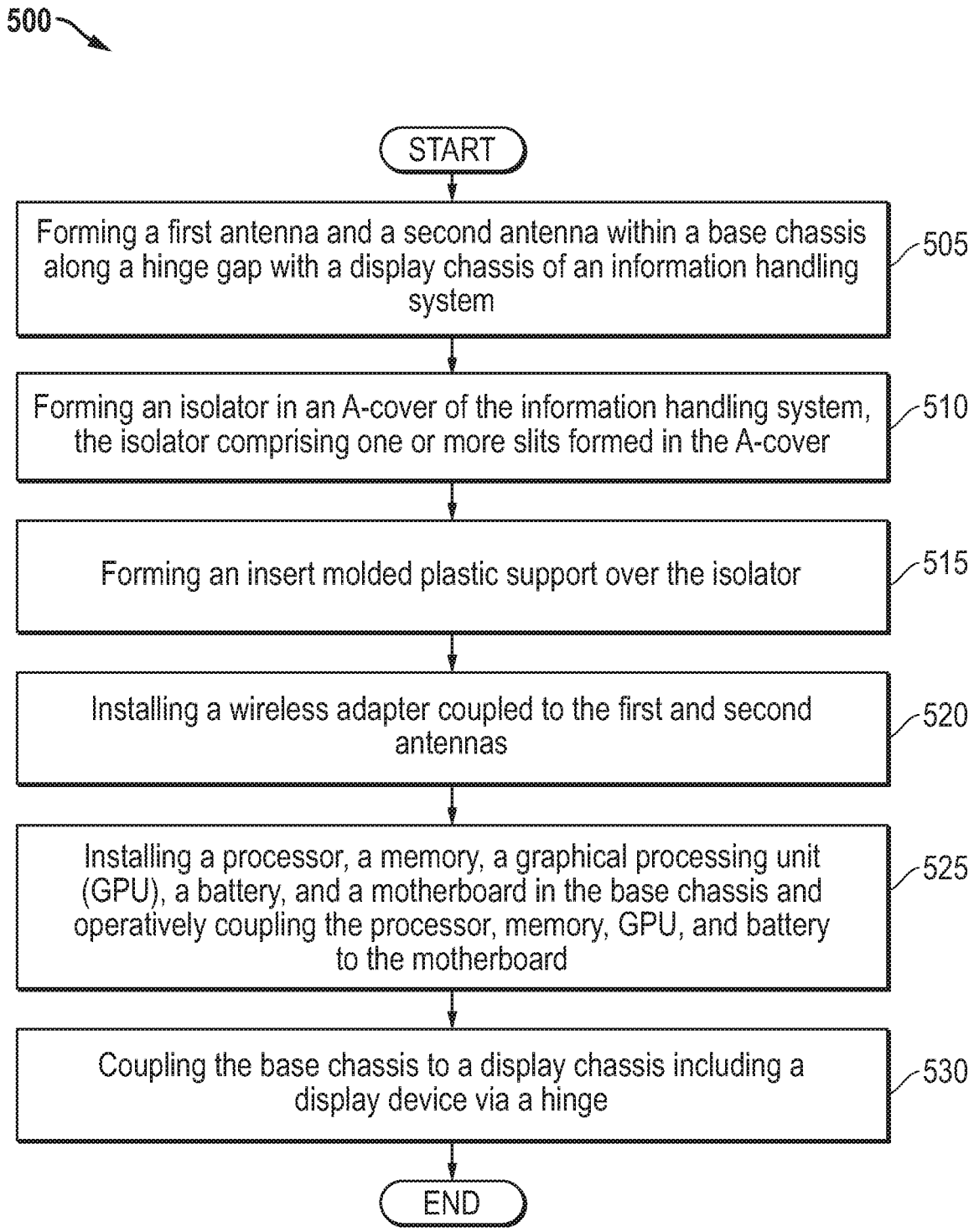
FIG. 5 is a flow diagram illustrating a method of manufacturing an information handling system having a plurality of antennas within a C-cover near a hinge according to an embodiment of the present disclosure.

FIG. 5 is a flow diagram illustrating a method 500 of manufacturing an information handling system having a plurality of antennas near a hinge cavity according to an embodiment of the present disclosure. The method 500 may begin at block 505 with forming a first antenna and a second antenna within a base chassis along a hinge gap with a display chassis of an information handling system. As described herein in some embodiments, the first antenna may be selected to emit a HF band or a higher frequency, or harmonics thereof, while the second antenna may be selected to emit other channels of an HF bands or an RF lower than a HF band or harmonics thereof. Alternative RF EM waves may be emitted by either of the first antenna or second antenna and the present specification contemplates these alternative RF EM waves being emitted.

The method 500 may continue at block 510 with forming an isolator in an A-cover of the information handling system, the isolator comprising one or more slits formed in the A-cover. In an embodiment, the isolator may be a window cut out of the hinge gap adjacent edge of the A-cover. In an embodiment, the isolator may further be formed with a separate pronged piece of metal apart from the A-cover and coupled to the A-cover by, for example, welding the isolator to the A-cover to form an electrically coupled pronged edge in the cut-out window. The pronged piece of metal may be stamped metal and may be sized to conform to the expected antenna bandwidth to be used at the first and second antennas.

The isolator pronged piece of metal may conform with a shape of the A-cover. In some embodiments described herein, the A-cover drops down towards the C-cover and D-cover towards the back creating an aesthetically appealing metal chassis. When in an open or semi-open configuration, a portion of the A-cover that slopes down may be oriented at a top portion of the C-cover and D-cover assembly so that the isolator formed in the A-cover is sloped towards a portion of the C-cover. In any of these embodiments, the isolator pronged piece of metal may be formed to conform to the slope formed within the A-cover so that the look and feel of this slope formed at the edge of the A-cover remains constant. The pronged piece of metal may also be placed and operatively coupled within the cut-out window of the A-cover to provide spacing of the slit width for effective isolation of the expected antenna frequency bands. The spacing may be determined for isolation in some embodiments. In other embodiments, spacing and prong size are tuned for enhanced cavity gap resonance.

The method 500 may include forming an insert molded plastic support over the isolator pronged piece of metal. The insert molded plastic support may be compression molded to cause the plastic to also conform to the slope or a bevel formed in the edge of the A-cover at block 515. The insert molded plastic support may be made of any RF transparent material such as a plastic and may be co-molded with the isolator pronged piece of metal using, for example, a nano molding technology that allows for direct bonding of the insert molded plastic to the pronged piece of metal. When the insert molded plastic support is formed over the slits of the isolator and pronged piece of metal, the insert may have a color added to it to visibly hide the presence of the insert. By coloring the insert, the aesthetics of the information handling system are maintained.

The method 500, at block 520 may also include installing a wireless adapter coupled to the first and second antennas. The wireless adapter can provide connectivity to a network, e.g., a wide area network (WAN), a local area network (LAN), wireless local area network (WLAN), a wireless personal area network (WPAN), a wireless wide area network (WWAN), or other network. In particular, high wireless bandwidth 5G connectivity may be established through at least the first and second antennas such a WiGig in some embodiments. In an example embodiment, the first and second antennas along with other antennas formed elsewhere may be used to create a 4×4 LTE antenna system for gigabit 5G LTE data transmission speeds. The wireless adapter may include one or more RF subsystems 130 with transmitter/receiver circuitry, modem circuitry, one or more unified antenna front end circuits, one or more wireless controller circuits such as antenna adaptation controller, amplifiers, antenna systems and other radio frequency (RF) subsystem circuitry for wireless communications via multiple radio access technologies. Each radiofrequency subsystem may communicate with one or more wireless technology protocols.

The method 500 may include at block 525 installing a processor, a memory, a graphical processing unit (GPU), a battery and power system, and a motherboard in the base chassis and operatively coupling the processor, memory, GPU, and battery to the motherboard. In an embodiment, other types of devices such as a keyboard or other input device may also be formed within the base chassis so as to provide further functionalities at the information handling system. The present specification contemplates the use of these other types of devices.

The method 500 may continue with, at block 530, coupling the base chassis to a display chassis including a display device via a hinge. As described herein, the hinge may cooperate with the edge resonant isolator to contain resonant frequencies of at least one of a plurality of antenna elements so as to increase the efficiency of the RF transceiving capabilities of the at least one antenna while preventing destructive interference between the first antenna and any other antenna element during operation.

The blocks of flow diagram of FIGS. 4 and 5 discussed above need not be performed in any given or specified order. It is contemplated that additional blocks, steps, or functions may be added, some blocks, steps or functions may not be performed, blocks, steps, or functions may occur contemporaneously, and blocks, steps or functions from one flow diagram may be performed within another flow diagram.

Although only a few exemplary embodiments have been described in detail herein, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims. In the claims, means-plus-function clauses are intended to cover the structures described herein as performing the recited function and not only structural equivalents, but also equivalent structures.

The above-disclosed subject matter is to be considered illustrative, and not restrictive, and the appended claims are intended to cover any and all such modifications, enhancements, and other embodiments that fall within the scope of the present invention. Thus, to the maximum extent allowed by law, the scope of the present invention is to be determined by the broadest permissible interpretation of the following claims and their equivalents, and shall not be restricted or limited by the foregoing detailed description.

What is claimed is:

1. An information handling system to wirelessly transmit and receive data at an antenna comprising:

a processor;

a memory;

a wireless adapter operatively coupled to a first antenna and a second antenna to wirelessly transceiver data;

a metal base chassis containing components of the information handling system, the base metal chassis including a C-cover and D-cover housing the components;

a metal display chassis containing a display device, the display metal chassis including an A-cover and a B-cover housing the components;

a hinge cavity formed at a hinge used to couple the base metal chassis and display metal chassis;

a first antenna element formed within the C-cover near the hinge cavity;

a second antenna element formed within the C-cover near the hinge cavity; and an edge resonant isolator formed into an edge of the A-cover to disrupt an electrical ground coupling path formed between the metal base chassis and metal display chassis at the hinge cavity, wherein the edge resonant isolator comprises:

a window cut-out; and a plurality of slits formed into the edge of the A-cover from prongs in the window cut-out.

2. The information handling system of claim 1, wherein the slits of the edge resonant isolator are formed of a pronged piece of metal operatively coupled to the A-cover in the window cut-out.

3. The information handling system of claim 1, wherein the slits are metal prongs of the of the edge resonant isolator are operatively coupled to the A-cover and covered by a molded plastic support.

4. The information handling system of claim 1, wherein the plurality of slits are sized and spaced relative to the first antenna element to excite a target frequency band in the hinge cavity by the first antenna element.

5. The information handling system of claim 1, wherein the edge resonant isolator isolates a radio-frequency (RF) electromagnetic (EM) wave emitted by the first antenna element from an RF EM wave emitted by the second antenna element.

6. The information handling system of claim 1, wherein the plurality of slits causes a current path to form up and down the plurality of slits along the edge of the A-cover adjacent to the hinge gap containing a RF EM field distribution at the edge resonant isolator.

7. The information handling system of claim 1, wherein a pronged piece of metal of the edge resonant isolator is welded onto a portion of the A-cover where the window has been cut out.

8. A metal base chassis and metal display chassis assembly for an information handling system comprising:

a processor;

a memory;

a wireless adapter operatively coupled to a first antenna and a second antenna to wirelessly transceiver data;

a hinge cavity formed between the metal base chassis and the metal display chassis, the base metal chassis including a C-cover and D-cover and the display metal chassis including an A-cover and a B-cover;

the first antenna formed within the C-cover by the hinge cavity;

the second antenna formed within the C-cover by the hinge cavity; and an edge resonant isolator formed into an edge of the A-cover adjacent to the hinge cavity to disrupt an electrical ground coupling path formed between the metal base chassis and metal display chassis at the hinge cavity, wherein the edge resonant isolator has a plurality of slits formed into the A-cover from the edge and sized to isolate the first antenna and the second antenna along the hinge cavity.

9. The assembly of claim 8, wherein a pronged piece of stamped metal is electrically coupled in a window cut-out of the edge of the A-cover to form the edge resonant isolator.

10. The assembly of claim 8, wherein the edge resonant isolator covered by a molded plastic support formed in the A-cover.

11. The assembly of claim 8, wherein the plurality of slits are spaced along the edge of the A-cover relative to the first antenna to form a resonant cavity in the hinge gap to be excited at a target frequency band.

12. The assembly of claim 8, wherein the edge resonant isolator isolates a radio-frequency (RF) electromagnetic (EM) wave emitted by the first antenna from an RF EM wave emitted by the second antenna.

13. The assembly of claim 8, wherein the plurality of slits causes a current path to form up and down the plurality of metal prongs forming the slits containing an RF EM field distribution at the edge resonant isolator.

14. The assembly of claim 8, wherein the first antenna and the second antenna are concurrently transceiving 5G LTE antennas.

15. An information handling system to transmit a communication signal comprising:

a metal base chassis containing components of the information handling system including a processor, a memory, and a wireless adapter, the base metal chassis including a C-cover and D-cover housing the components;

a metal display chassis containing components of the information handling system, the display metal chassis including an A-cover and a B-cover;

a hinge cavity formed at a hinge used to couple the metal base chassis and metal display chassis;

a first antenna element formed within the C-cover by the hinge cavity;

a second antenna element formed within the C-cover by the hinge cavity;

a metal pronged edge resonant isolator formed into an edge of the A-cover to disrupt an electrical ground coupling path formed between the base metal chassis and display metal chassis at the hinge cavity, wherein the metal pronged edge resonant isolator includes a plurality of slits formed into the A-cover among prongs of the metal pronged edge isolator;

the plurality of slits comprising a first set of narrow slits and a second set or relatively wider slits to decouple high band frequencies from lower-band frequencies respectively.

16. The information handling system of claim 15, wherein a pronged piece of stamped metal is electrically coupled in a window cut-out of the edge of the A-cover to form edge resonant isolator.

17. The information handling system of claim 15, wherein the plurality of slits are placed relative to the first antenna element to isolate the first antenna element from resonance down the hinge gap beyond the isolation element.

18. The information handling system of claim 15, wherein the edge resonant isolator isolates a radio-frequency (RF) electromagnetic (EM) wave emitted by the first antenna element from an RF EM wave emitted by the second antenna element.

19. The information handling system of claim 15, wherein the edge resonant isolator formed in a cut-out from the edge of the A-cover is covered by a molded plastic support cover.

20. The information handling system of claim 15, wherein the plurality of slits causes a current path to form up and down metal prongs of the plurality of slits containing an RF EM field distribution at the edge resonant isolator.

* * * * *